US011551504B2

(12) United States Patent
Schwarber et al.

(10) Patent No.: US 11,551,504 B2
(45) Date of Patent: Jan. 10, 2023

(54) SELECTING AND DISPENSING BLENDED BEVERAGES FROM A POST-MIX BEVERAGE DISPENSER

(71) Applicant: The Coca-Cola Comapny, Atlanta, GA (US)

(72) Inventors: Joshua Schwarber, Atlanta, GA (US); Kyusang Kim, Atlanta, GA (US); Scott Cuppari, Smyma, GA (US); Scott Harrison, Atlanta, GA (US); Franchot Chang, Marietta, GA (US); Hitesh Patel, Marietta, GA (US)

(73) Assignee: The Coca-Cola Company, Atlanta, GA (US)

( * ) Notice: Subject to any disclaimer, the term of this patent is extended or adjusted under 35 U.S.C. 154(b) by 1001 days.

(21) Appl. No.: 16/326,031

(22) PCT Filed: Aug. 15, 2017

(86) PCT No.: PCT/US2017/046926
§ 371 (c)(1),
(2) Date: Feb. 15, 2019

(87) PCT Pub. No.: WO2018/035113
PCT Pub. Date: Feb. 22, 2018

(65) Prior Publication Data

US 2019/0172297 A1 Jun. 6, 2019

Related U.S. Application Data

(60) Provisional application No. 62/375,390, filed on Aug. 15, 2016.

(51) Int. Cl.
*G07F 13/06* (2006.01)
*B67D 1/00* (2006.01)
(Continued)

(52) U.S. Cl.
CPC ..... *G07F 13/065* (2013.01); *B67D 1/0021* (2013.01); *G07F 9/006* (2013.01); *G07F 9/0235* (2020.05)

(58) Field of Classification Search
CPC .... G07F 13/06; G07F 13/065; G06F 3/04883; B67D 1/0021
See application file for complete search history.

(56) References Cited

U.S. PATENT DOCUMENTS 8,701,050 B1 * 4/2014 Starner ..... G06F 3/04883 715/857
2012/0029691 A1 * 2/2012 Mockus ..... H04W 4/02 700/231

(Continued)

FOREIGN PATENT DOCUMENTS

CN 102855084 A 1/2013
CN 103797499 A 5/2014

(Continued)

OTHER PUBLICATIONS

Extended European Search Report corresponding to Europe Application No. 17841985.9, dated Apr. 3, 2020.

(Continued)

*Primary Examiner* — Timothy R Waggoner
(74) *Attorney, Agent, or Firm* — Foley & Lardner LLP

(57) ABSTRACT

A system and method for creating a mixed consumable item may include displaying a first set of selectable indicia on a touchscreen, where the indicia may be (i) indicative of respective consumable ingredients and (ii) distinctly positioned relative to one another. A swype gesture may be received from a user via the touchscreen that forms a path extending between a first position and a second position that touches or passes close to multiple selectable indicia. From the first set of consumable ingredients, a plurality of combinations of consumable ingredients most likely to have (Continued)

been intended to be selected by the user based on the path of the swype gesture may be predicted. Selectable predicted combinations of consumable ingredients may be displayed on the touchscreen to enable one of the selectable combinations of consumable ingredients to be selected by the user for mixing by a dispenser of consumable items.

18 Claims, 21 Drawing Sheets

(51) Int. Cl.
*G07F 9/02* (2006.01)
*G07F 9/00* (2006.01)

(56) References Cited

U.S. PATENT DOCUMENTS

2013/0096715 A1 4/2013 Chung et al.
2013/0106690 A1* 5/2013 Lim ..... G06F 3/04886 345/173
2015/0046877 A1* 2/2015 Cuppari ..... G06F 3/04842 715/834
2015/0082243 A1* 3/2015 Taylor ..... G07F 9/002 715/814
2015/0324116 A1* 11/2015 Marsden ..... G06F 3/04886 345/158
2016/0052770 A1* 2/2016 Ratti ..... A47J 43/27 901/30
2016/0092039 A1 3/2016 Chien et al.
2020/0031656 A1* 1/2020 Rudick ..... G06F 1/1626

FOREIGN PATENT DOCUMENTS

CN 104885072 A 9/2015
CN 105579204 A 5/2016
WO WO-2015/191276 A1 12/2015

OTHER PUBLICATIONS

International Search Report and Written Opinion corresponding to PCT Patent Application No. PCT/US2017/046926, filed Oct. 25, 2017, 3 pages.

* cited by examiner

SELECTING AND DISPENSING BLENDED BEVERAGES FROM A POST-MIX BEVERAGE DISPENSER

REFERENCE TO RELATED APPLICATION

This application claims the benefit of U.S. provisional application No. 62/375,390, filed Aug. 15, 2016, and PCT application No. PCT/US2017/046926 filed Aug. 15, 2017; the contents of which are herein incorporated by reference in their entirety.

BACKGROUND

Beverage and food dispensers typically have a user interface that enables users to select particular consumable beverage and/or food items ("consumable items"). As an example, dispensers of packaged consumable items typically use pushbuttons to enable users to select a particular consumable item. With more recently developed beverage dispensers, it is possible to provide users with many different beverage brands and flavors of the respective brands for selection. For such recently developed beverage dispensers, electronic displays in the form of touchscreens are typically used to display indicia representative of brands and/or flavors of brands available. A user of the dispenser may individually select a brand and flavor of the brand by tapping indicia that shows a name and/or logo, and then press another indicia or pushbutton to cause the selected brands and flavors thereof to be dispensed by the dispenser.

SUMMARY

To improve a user interface of a consumable item dispenser capable of mixing multiple consumable ingredients, functionality that enables the user to use a swype gesture on the touchscreen across and/or near multiple indicia to select consumable items to be mixed by the dispenser may be provided. However, because users of touchscreens who use swype gestures may be inaccurate (e.g., swype across unintended indicia or near, but not onto an intended indicia), a prediction process inclusive of determining a selectable set of combinations of consumable ingredients most likely to have been intended to be selected by the user may be utilized. The determined selectable set of combinations of consumable ingredients may be displayed for a user to select. A prediction may be made using a path of the swype gesture that passes across or near indicia to form a set of indicia (e.g., three brands). Responsive to the user selecting a combination of consumable ingredients, the user may be enabled to select a percentage of each of the selected consumable ingredients to dispense to form a mixed consumable item. In predicting, a database that stores information associated with each of the indicia may be accessed to select information of each consumable ingredient along and/or near the path of the swype based on statistics, such as historical swypes of the user or previous users. A variety of statistical processes and/or measurement techniques from points along the swype path may be used in predicting intended consumable ingredients.

To enable a user to test results of mixing consumable items in real-time, a dispenser may be configured with an electronic display that enables the user to select multiple consumable ingredients for mixing. A mixing user interface may enable the user to set a percentage of each selected consumable ingredient to include in a mixed consumable item (a "mix"). The information representative of the selected consumable ingredients along with the user-set percentages of the selected consumable ingredients may be communicated to a remote electronic device for storage thereat so as to enable the user to later communicate the mix information back to the same or different dispenser for dispensing a consumable item (e.g., beverage) with the same mix ingredients (e.g., same brands, flavors of brands, and percentages of each). The electronic device may be a mobile electronic device, such as a smartphone, database located on the "cloud" or Internet, or other electronic device.

One embodiment of a system and method for creating a mixed consumable item may include displaying a first set of selectable indicia on a touchscreen, where the indicia may be (i) indicative of respective consumable ingredients and (ii) distinctly positioned relative to one another. A swype gesture may be received from a user via the touchscreen that forms a path extending between a first position and a second position that touches or passes close to at least two of the selectable indicia. From the first set of consumable ingredients, a plurality of combinations of consumable ingredients most likely to have been intended to be selected by the user based on the path of the swype gesture may be predicted. Selectable predicted combinations of consumable ingredients may be displayed on the touchscreen to enable one of the selectable combinations of consumable ingredients to be selected by the user for mixing by a dispenser of consumable items.

One embodiment of a method for creating a mixed consumable item may include displaying a first set of selectable indicia on an electronic display of a dispenser configured to dispense consumable items, where the first set of selectable indicia may be indicative of respective consumable ingredients. An indication of a selected first consumable ingredient may be received in response to a user selecting a first indicia. An indication of a selected second consumable ingredient may be received in response to a user selecting a second indicia. A mixer user interface that enables the user to select a mix percentage for each of the selected first and second consumable ingredients may be displayed on the electronic display. The mixed consumable item containing the selected mix percentages of the selected first and second selected consumable ingredients may be dispensed by the dispenser.

BRIEF DESCRIPTION

A more complete understanding of the method and apparatus of the present invention may be obtained by reference to the following Detailed Description when taken in conjunction with the accompanying Drawings wherein.

DETAILED DESCRIPTION OF THE DRAWINGS

Figure 1:
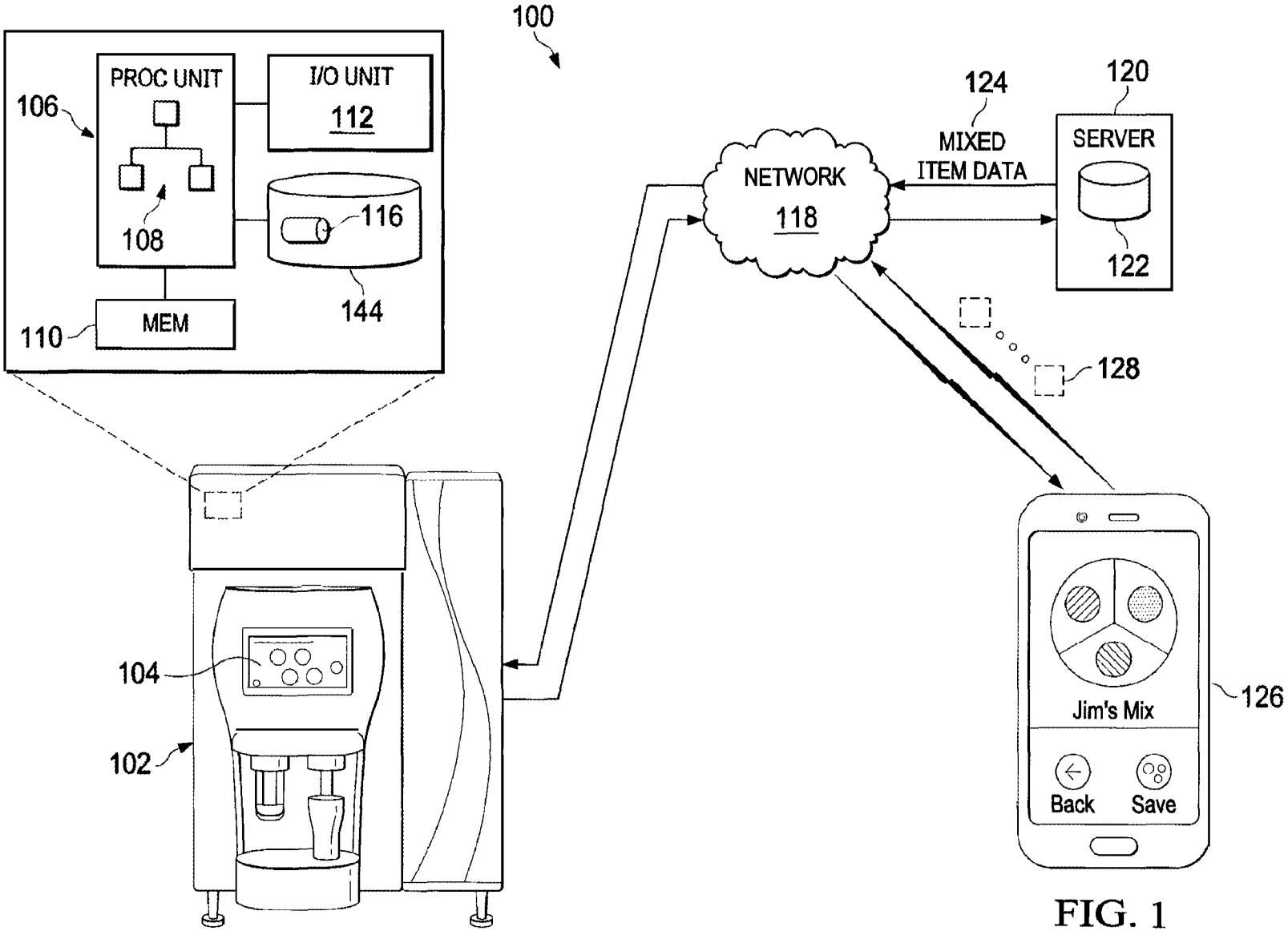
FIG. 1 is an illustration of an illustrative dispenser environment inclusive of a consumable item dispenser configured to dispense mixed consumable items formed by selected consumable ingredients as selected by a user.

With regard to FIG. 1, an illustration of an illustrative dispenser environment 100 inclusive of a consumable item dispenser 102 configured to dispense mixed consumable items formed by selected consumable ingredients as selected by a user is shown. The dispenser 102 may include an electronic user interface ("UI") 104, such as a touchscreen, that enables selectable indicia to be displayed. To control the dispenser 102 and UI 104, a processing unit 106 may be utilized to execute machine readable instructions 108 to perform a variety of functions, as further described herein. The processing unit 106 may include one or more computer processors and/or discrete electronic devices. In an embodiment, the processing unit 106 may include an EEPROM, FPGA, ASIC, discrete logic, or any combination thereof for performing one or more functions to read swype paths, perform image and/or signal processing of the swype paths relative to the displayed indicia, and perform other functions and further described herein.

The processing unit 106 may be in communication with a memory 110 that may be configured to store data, such as information associated with the consumable ingredients, that may be used for display on the UI 104. An input/output (I/O) unit 112 may enable the dispenser 102 to communicate information externally from the dispenser 102 utilizing any wired and/or wireless communications protocol, as understood in the art. A storage unit 114 may be configured to store a data repository or database 116 that stores information of consumable ingredients (not shown) available to be dispensed by the dispenser 102. The consumable ingredients may be foods, beverages, beverage concentrates, flavors, additives, powders, liquids, or any combination thereof. As an example, the dispenser 102 may be configured to dispense drinks, such as soft-drinks, coffees, teas, sports drinks, alcoholic beverages, and so forth. Alternatively, the dispenser 102 may be configured to dispense foods, such as ice creams, optionally with toppings or mix-ins, milkshakes, snack mixes, hot foods, and so forth. Still yet, the dispenser 102 may be configured to dispense a combination of foods and beverages, such as (i) soups with noodles, rice, and/or protein (chicken, beef, shrimp), (ii) hot chocolate with marshmallows, (iii) soup and salad, and so on.

As further shown, the dispenser 102 may be configured to communicate data over a communications network 118 with a server 120 operating a storage unit 122 for storing information associated with users, as further described herein. In an embodiment, the dispenser 102 may be configured to communicate mixed item data 124 via the communications network 118 to the server 120 for storage within a database being stored by the storage unit 122. The user may utilize an electronic device 126, such as a smartphone, to communicate information via data packets 128 or other communications protocol with the dispenser 102 and/or server 120, as further described herein.

Figure 2:
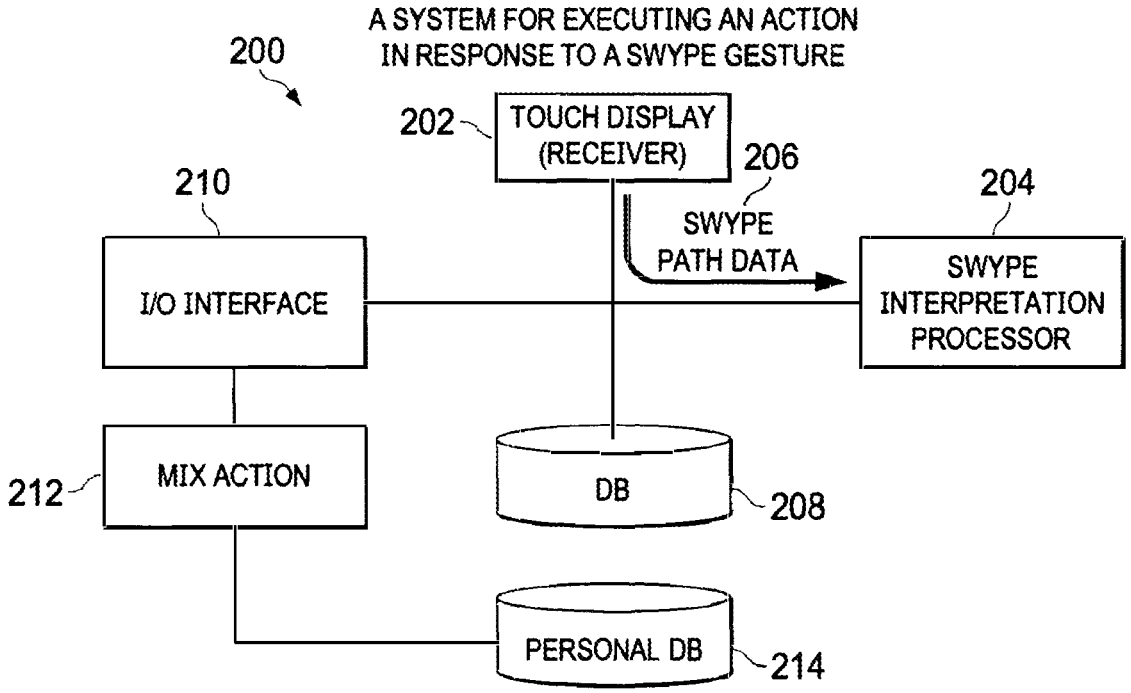
FIG. 2 is a block diagram of an illustrative hardware configuration for controlling operation of a dispenser of consumable items in response to a swype gesture.

With regard to FIG. 2, a block diagram of an illustrative hardware configuration 200 for controlling operation of a dispenser of consumable items in response to a swype gesture is shown. The hardware configuration 200 may include electronics and/or mechanical components that control selection of consumable items to be mixed by the dispensing components stored in reservoirs, storage bins, or otherwise via conduits, nozzles, valves, or other food and/or beverage dispensing mechanism.

The hardware configuration 200 may include a touch display or touchscreen 202 configured to receive input from a user. As understood in the art, a touchscreen 202 may be able to sense or record touches to discrete locations or swype gestures along a swype path from a first position to a second position on the touchscreen 202. The swype gestures may be performed to select a plurality of consumable ingredients (e.g., beverage brands) represented by indicia displayed on the touchscreen 202, as further described herein. To interpret a swype path by a user, a swype interpretation processor 204 may be configured to receive swype path data 206 generated by the touchscreen 202 that may include X, Y coordinates on the touchscreen 202 touched by a user. The swype interpretation processor 204 may be a general processor, digital signal processor, EEPROM, ASIC, or any other processor or circuit that is configured to perform swype processing or other functions in addition to the swype processing.

The touch display 202 and swype interpretation processor 204 may be in communication with a database 208 that may be configured to store information that is displayed on the touch display 202 and/or accessed by the swype interpretation processor 204 for use in enabling the swype interpretation processor 204 to predict indicia indicative of selectable consumable ingredients that were intended to have been swyped or close to being swyped by a user.

An input/output (I/O) interface 210 may be configured to communicate data within and externally from the hardware configuration 200 of the dispenser. The I/O interface 210 may communicate information in any communications protocol, as understood in the art, including both wired and wireless that is local (e.g., Bluetooth®, Wi-Fi®) or remotely located over a wide-area communications network, such as the Internet, mobile communications network, or otherwise. In an embodiment, the I/O interface 210 may be configured to communicate with the touch display 202, swype interpretation processor 204, and database 208. The I/O interface 210 may further be in communication with any other electronics, including a communications device (e.g., modem, RFID reader, or code reader, etc.) for communicating data external from the dispenser. A mix action 212 may be an instruction and/or data that is responsive to an input by a user to perform at the dispenser, such as a mix selection request to mix consumable ingredients, flavors, and percentages to be mixed into a mixed consumable item, as further described herein. Data or information of the mix action 212 may be stored in a personal database 214 in association with a user. The personal database 214 may be temporary (e.g., predetermined number of minutes or event driven, such as until another user utilizes the dispenser) or more permanent (e.g., stored until actively deleted by a user or otherwise, such as the user indicating that he or she is finished or the dispenser automatically determining that the user is finished). The mix action 212 may also include a request to pour a mixed consumable item, communicate a code representative of a desired mix by the user to his or her electronic device or to a friend, or perform any other mix action 212, as further described herein.

Figure 3:
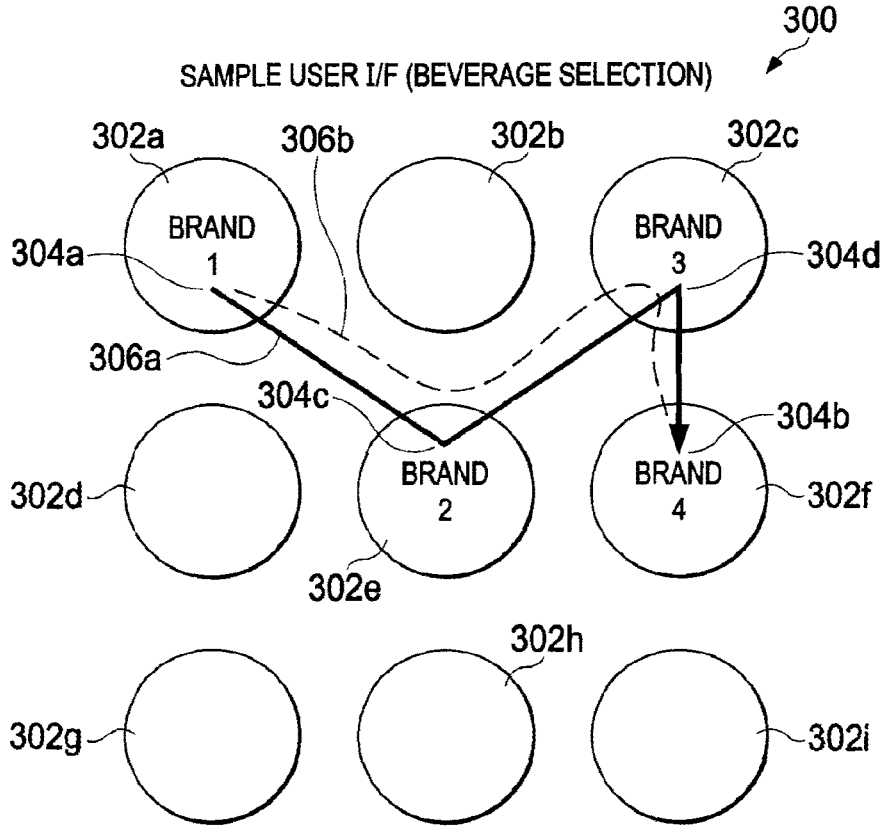
FIG. 3 is an illustration of an illustrative user interface that enables a user to select one or more brands of consumable ingredients for inclusion in a consumable item.

With regard to FIG. 3, an illustration of an illustrative user interface 300 that enables a user to select one or more brands of consumable ingredients for inclusion in a consumable item is shown. The user interface 300 is shown to include multiple indicia 302*a*-302*i* (collectively 302) within which brands of consumable ingredients may be displayed. The brands may be displayed with words and/or logos within the indicia, in this case circles, that are distinctly positioned with respect to one another. In other words, the indicia 302 have gaps separating adjacent indicia, thereby reducing the chance that a user will inadvertently select an incorrect consumable ingredient. It should be understood, however, that adjacent indicia may be physically defined without having gaps displayed therebetween (e.g., checkerboard layout). Moreover, while the user interface 300 is shown with a pushbutton telephone configuration with the indicia 302 being arranged in rows and columns, alternative configurations (e.g., circular or other pattern or layout) of the indicia may be utilized. Indicia 302 may be configured as alternative shapes and/or sizes, as well.

Users of touchscreens on which the user interface 300 may be displayed may select brands by discretely tapping each of the individual indicia, such as indicia 302*a* (brand 1), indicia 302*d* (brand 2), indicia 302*c* (brand 3), and indicia 302*f* (brand 4), as is conventionally available. However, to simplify and expedite selection of the brands, the principles described herein may enable swiping gestures on the user interface 300 being presented on the touchscreen. The swiping gestures may enable the user to start touching the touchscreen at a first location, such as starting point 304*a*, and swiping to a second location, such as an end point 304*b*, so as to form a swype path 306*a* therebetween that includes transition or inflection points 304*c* and 304*d*. The transition points may be any point at which a path changes trajectory, which may indicate an intention that the user has selected a brand when the transition point occurs on or near an indicia. Along the swype path 306*a*, indicia 302*a*, 302*e*, 302*c*, and 302*f* are intended to be selected, where indicia 302*e* and 302*c* may be considered filler ingredients.

In an embodiment, a swype processor (see FIG. 2), which may be a general processor that executes a swype processing software module, may be configured to determine indicia that a user intended to select. In the case of the user touching specific indicia, such as shown in FIG. 3, a swype processor may readily identify with a high degree of certainty the desired selection by the user. However, in the event that the user does not touch consecutive indicia, but rather swypes near an indicia, the swype processor may determine possible brand selections by comparing the path of the swype and indicia that is closest to the swype path one or more subsets of the swyped indicia. If the number of ingredients that are possible to be mixed has a maximum value (e.g., 4 ingredients), then the swype processor may perform mixing predictions for mixes having between 2 and 4 ingredients. If the user has historically selected a mix of 3 ingredients, then the swype processor may be biased to providing 3 ingredient mix combinations. It should be understood that a number of different prediction algorithms may be utilized that are based on or not based on historical knowledge of the user or larger populations of users.

If, as the example of the swype path 306*a* shows, the user selects four indicia (e.g., indicia 302*a*, 302*d*, 302*c*, and 302*f*), but the dispenser is limited to mixing three consumable ingredients, the swype processor may predict permutations of three consumable ingredients from consumable ingredients shown in the four selected indicia. As another example of a swype path that does not touch a desired indicia, swype path 306*b* shows how the user swyped starting from indicia 302, a near indicia 302*e*, and crossed indicia 302*c* and 302*f*. The swype processor may determine that the user intended to select indicia 302*e* as a result of swiping close to that indicia. In addition, the swype processor may make a determination that the user intended to only select indicia 302*a*, 302*c*, and 302*f*. As a result, the swype processor may present multiple possible swype paths for the user to select which of the desired swype paths the user intended (see FIG. 5). It should be understood that many variations of swype paths may be possible, and that the swype interpretation processor may be configured to determine using historical swype selections from the same or other users, statistical processing, learning algorithms, or otherwise to make the determination as to which swype path the user intended.

In one embodiment, the swype path processing may be configured to include a first swyped (or nearly swyped) indicia in a swype path and a last touched (or nearly swyped) indicia in the swype path. If the dispenser is limited to mixing three ingredients, due to pumping limitations or otherwise, then the swype processing may make certain predictions based on a transition or inflection point in the swype path. The swype path processing may make a set of predicted swype paths. As an example, if the user swypes indicia 302*a*, 302*h* (Brand 5), and 302*c*, then a set of predicted mixes may include mixes (1, 5, 3), (1, 2, 3), and (1, 4, 3). However, if historical knowledge (or manufacturer determination) suggests that a very low (e.g., below 5% with a reasonable sample size population) or no users combine brands 1 and 4 together, then the swype path processing may filter predictions based on that knowledge so as to, in this case, elimination the prediction that the user intended to swype mix (1, 4, 3), thereby leaving the set of predicted mixes of (1, 5, 3) and (1, 2, 3) for the user to select. Although not shown, the predictions may be accompanied with a suggestion message that indicates that "users who selected mix (1, 5, 3) also liked mixes (1, 6, 3) and (1, 6, 7)" based on historical knowledge of all users. Recommendations of mix percentages may also be provided based on the user's historical selections of the same or different mixes, or all users mix percentages of the same or different mixes.

Figure 4:
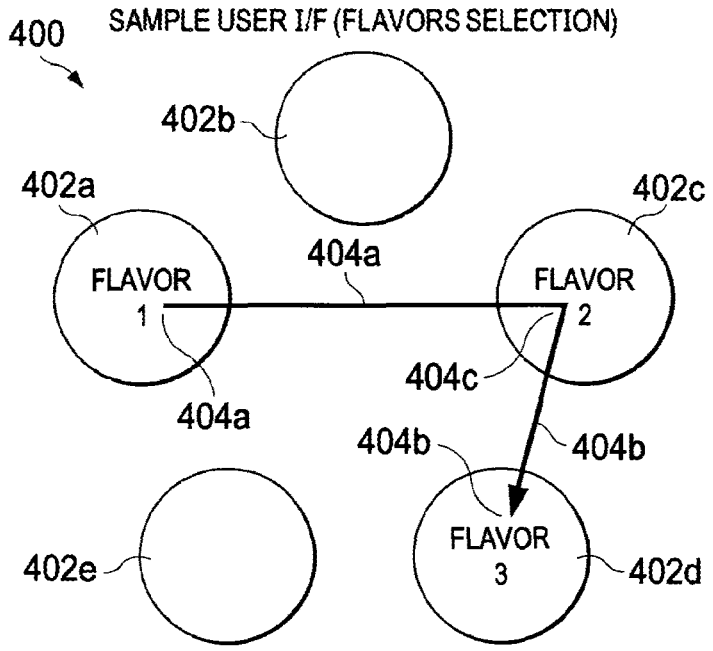
FIG. 4 is an illustration of an illustrative user interface in which multiple indicia are shown.

With regard to FIG. 4, an illustration of an illustrative user interface 400 in which multiple indicia 402*a*-402*e* (collectively 402) are shown is provided. The indicia 402 may include flavors of brands that were displayed in the indicia 302 in FIG. 3. That is, any brands that were selected by selecting an indicia in FIG. 3 may have multiple flavors of the selected brand that are selectable in FIG. 4. It should be understood that if multiple brands are selected in FIG. 3, that each brand may have a separate user interface for selection of a flavor of that brand. In an embodiment, one or more display screens showing different flavors of a selected brand may be displayed for a user to select desired flavors. Rather than presenting flavors, such as is often available for beverages, styles of processing may be available for food (e.g., mashed potatoes, French fried potatoes, baked potatoes, etc.) and beverages (e.g., hot coffee, frozen latte, etc.). Consistent with the user interface of FIG. 3, the indicia 402 may be individually selectable by a user tapping or touching the indicia, such as indicia 402*a*, 402*c*, and 402*d*, in selective order, or the user may select the different flavors 402*a*, 402*c*, and 402*d* through use of a swype gesture by touching the touch screen starting from starting point 404*a* and ending at stopping point 404*b* along with a wayward point 404*c*. The swype interpretation processor may similarly be used to determine indicia that were intended to have been selected. In an embodiment, each of the flavors displayed in the different indicia 402*a*, 402*c*, and 402*d* may be flavors associated with different brands that were selected in FIG. 3. Because three flavors were selected (i.e., flavors, 1, 2, and 3), the user likely selected three different brands of consumable ingredients in FIG. 3.

Figure 5:
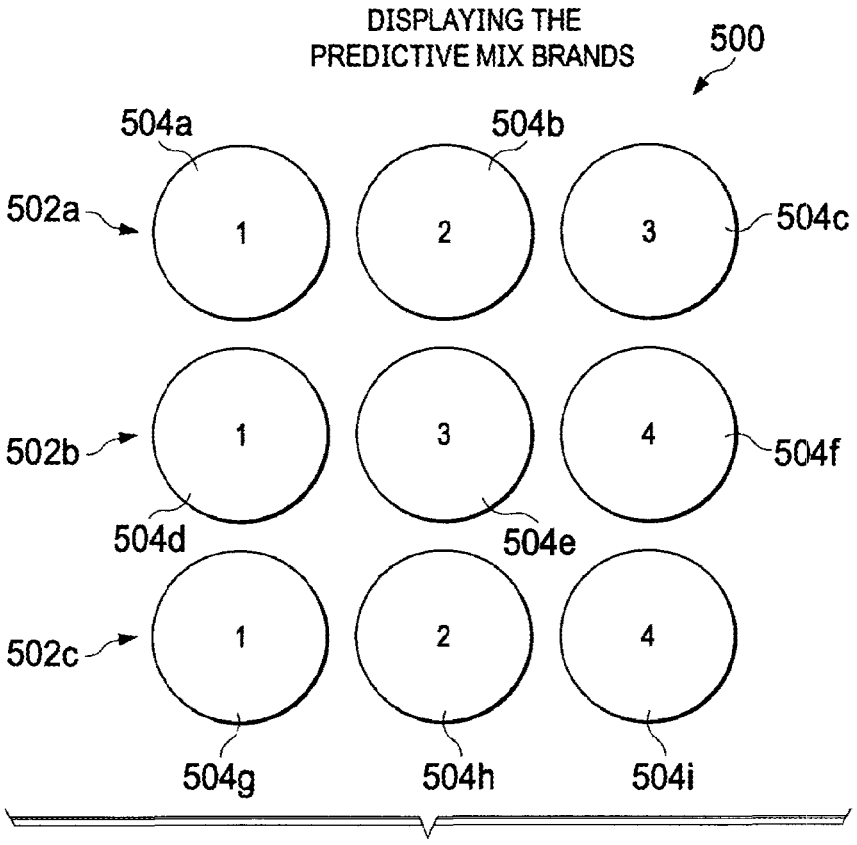
FIG. 5 is a user interface inclusive of multiple rows of predicted mixes of consumable ingredients inclusive of indicia containing information associated with consumable ingredient brands and/or flavors.

With regard to FIG. 5, a user interface 500 inclusive of multiple rows of predicted mixes of consumable ingredients 502*a*, 502*b*, and 502*c* (collectively 502) inclusive of indicia 504*a*-504*i* (collectively 504) containing information associated with consumable ingredient brands and/or flavors is shown. Each of the rows 502*a*, 502*b*, and 502*c* are representative of predicted mixes of consumable ingredients intended to have been selected by a user as performed by a swype interpretation processor. As an example, a prediction is made that the user intended to swype consumable ingredients 1, 2, and 3 (predicted mix 502*a*), consumable ingredients 1, 3, and 4 (predicted mix 502*b*), and consumable ingredients 1, 2, and 4 (predicted mix 502*c*). It should be understood that additional and/or alternative predicted mixes of consumable ingredients may be made. The rows of predicted mixes of consumable ingredients 502 may be selectable for a user to affirmatively indicate which consumable ingredients the user intended to have swyped through a swype gesture. It should be understood that the user interface 500 is illustrative, and that many alternative displays of predicted mixes may be presented to the user for selection of an intended mix of consumable ingredients. Responsive to the user selecting one of the rows of predicted mixes of consumable ingredients 502 by touching one of the rows or soft-button (not shown) associated therewith, a user interface, as shown in FIG. 6, may be presented to the user for the user to set percentages of each of the different brands/flavors selected by the user.

Figure 6:
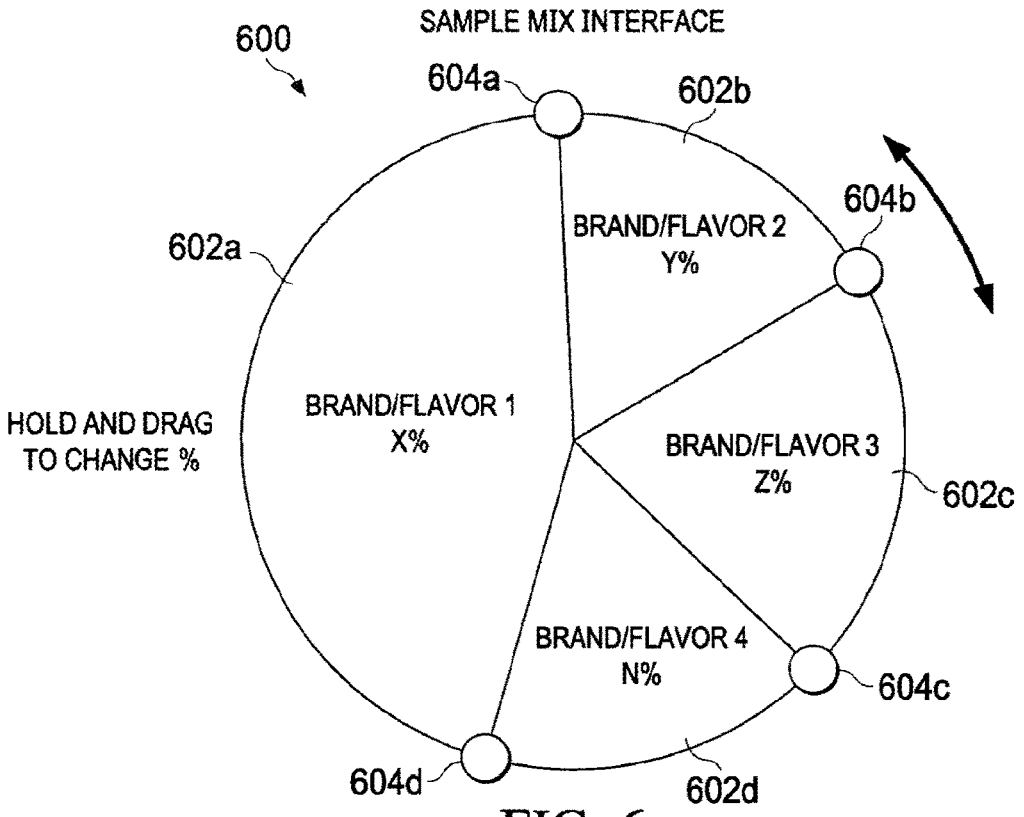
FIG. 6 is an illustration of an illustrative user interface inclusive of a pie chart that may be displayed on an electronic display, such as a touch screen.

With regard to FIG. 6, an illustration of an illustrative user interface inclusive of a pie chart 600 that may be displayed on an electronic display, such as a touch screen, is shown. The pie chart 600 may include each of the selected brands and flavors of those brands displayed in respective portions 602*a*, 602*b*, 602*c*, and 602*d* (collectively 602) of the pie chart 600. In one embodiment, each of the portions 602 of the pie chart 600 may initially be set having equal percentages (e.g., 25%). Selection points 604*a*, 604*b*, 604*c*, and 604*d* (collectively 604) may enable a user to select and alter percentages of the consumable items within respective portions 602 of the pie chart 600. As shown, brand/flavor 1 one has been altered to be X %, brand/flavor 2 has been altered to be Y %, brand/flavor 3 has been altered to be Z %, and brand/flavor 4 has been selected to be N %, such that a mixed consumable item having each of the consumable ingredients inclusive of brands/flavors 1-4 may be produced by a dispenser. The user interface 600, along with user interfaces 300 of FIG. 3, 400 of FIG. 4, and 500 of FIG. 5, may be displayed on a dispenser and/or electronic display (e.g., smartphone) owned by a user for the user to interact to create a mixed consumable item. The mixed consumable item may be a beverage, food items, or combination thereof. It should be understood that rather than using a pie chart 600, alternative configurations that enable a user to alter percentages of selected consumable ingredients may be utilized.

Figure 7:
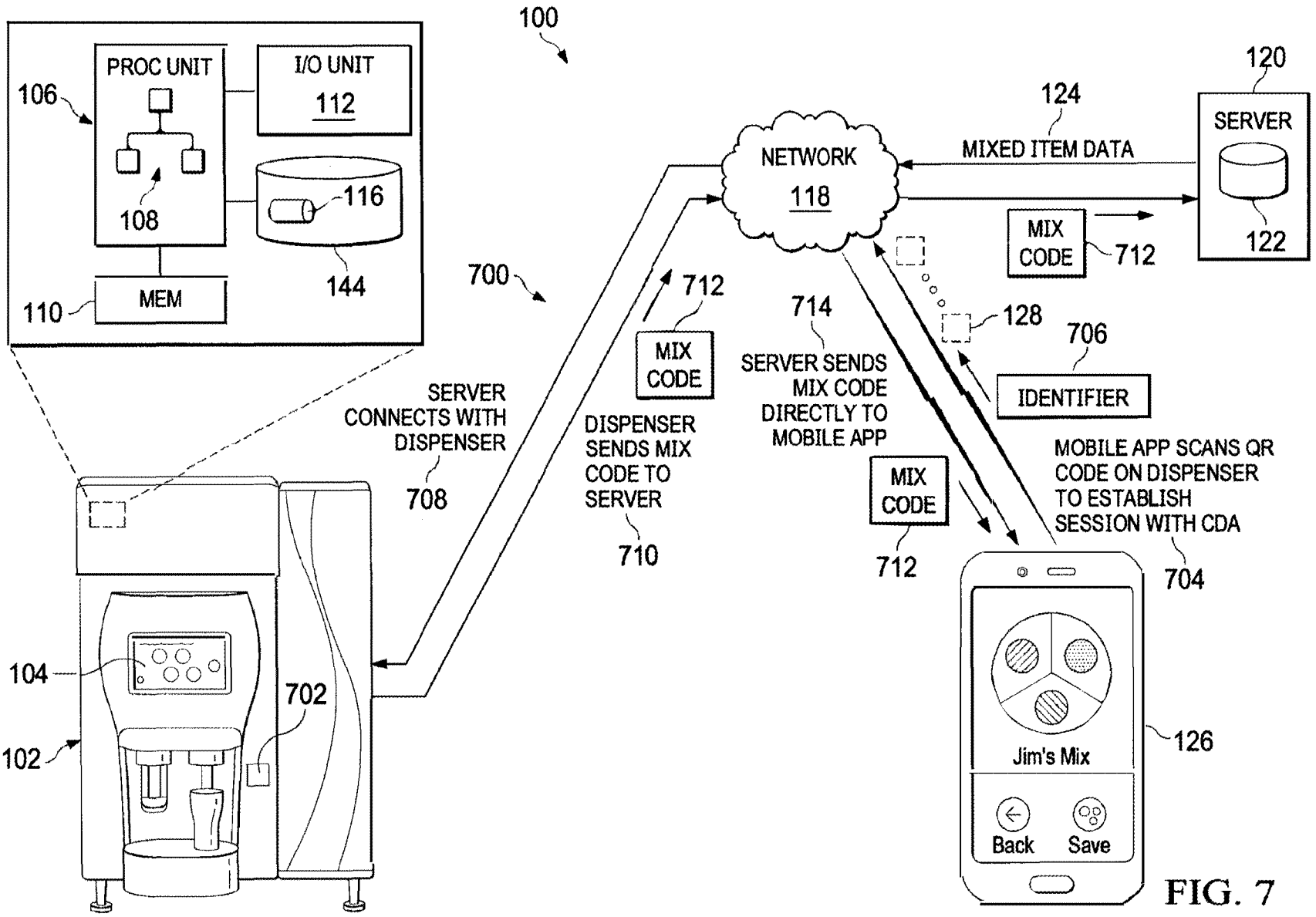
FIG. 7 is an illustration of the dispenser environment of FIG. 1 shown to include a communications process provided to a user by the dispenser via the electronic user interface and electronic device.

With regard to FIG. 7, an illustration of the dispenser environment 100 of FIG. 1 is shown to include a communications process 700 provided to a user by the dispenser 102 via the electronic user interface 104 and electronic device 126. In one embodiment, the user may utilize the electronic device 126 may be executing a mobile app, as understood in the art. In this embodiment, the user may use the dispenser 102 to create a mixed consumable item in a real-time manner, which allows the user to repeatedly set a mix, sample, adjust mix, sample, adjust mix, sample, etc., until a desired mixed consumable item is determined by the user. Responsive to the electronic device 126 capturing (e.g., imaging, scanning) an indicia 702 (e.g., QR code, barcode, or any other machine-readable code) physically positioned on the dispenser or displayed on the user interface 104 at step 704, the electronic device 126 may automatically initiate communications with the server 120 and communicate an identifier 706, such as dispenser number, network address, or other information associated with the indicia 702 via the data packets 128. In some embodiments, the identifier 706 may include an identification of the electronic device 126 or a user using the electronic device.

The server 120, responsive to receiving the identifier 706, may connect with the dispenser 102 identified by the identifier 706 via the communications network 118 at step 708 using a communications protocol, such as a wired and/or wireless communications protocol, as understood in the art. The user may create a mixed consumable item using the user interface 104 of the dispenser 102. A mix code 712 that defines the consumable ingredients and mix percentages thereof may be created by the dispenser 102, where the mix code 712 may be used by the dispenser 102 or other dispensers (not shown) to recreate the mixed consumable item created by the user. The creation of the mixed consumable item may be performed by the user prior to or after the electronic device 126 scans the indicia 702 and connects to the server 120. At step 710, the dispenser 102 may communicate the mix code 712 to the server 120 for storage thereat. For example, a consumer or profile may be stored in the database 122 in association with the device/user identification included with the identifier 706. At step 714, the server may communicate the mix code 712 to the electronic device 126 with which the server 120 is connected. The electronic device 126 that is operating the mobile app may store the mix code 712 for later viewing and usage, such as recommunicating to a dispenser for producing the mixed consumable item.

In an embodiment, the mix code 712 may include a user identifier (e.g., user name) and/or a dispenser so that the server 120 may store and generate information associated with a mix, such as number of shares, top mixers, top mixer generating dispensers, and so on. In an embodiment, dispensers may receive a mix code inclusive of the user identifier, and, responsive to receiving a mix code, communicate the mix code to the server 120, which, in turn, may communicate a notification to a mobile app (or other communication protocol) being used by the user associated with the user identifier to inform the user that his or her mix is being used (optionally by a particular user and on a particular dispenser). Other information may be included as part of the mix code and used for information, social engagement, contest, or other purposes.

Figure 8:
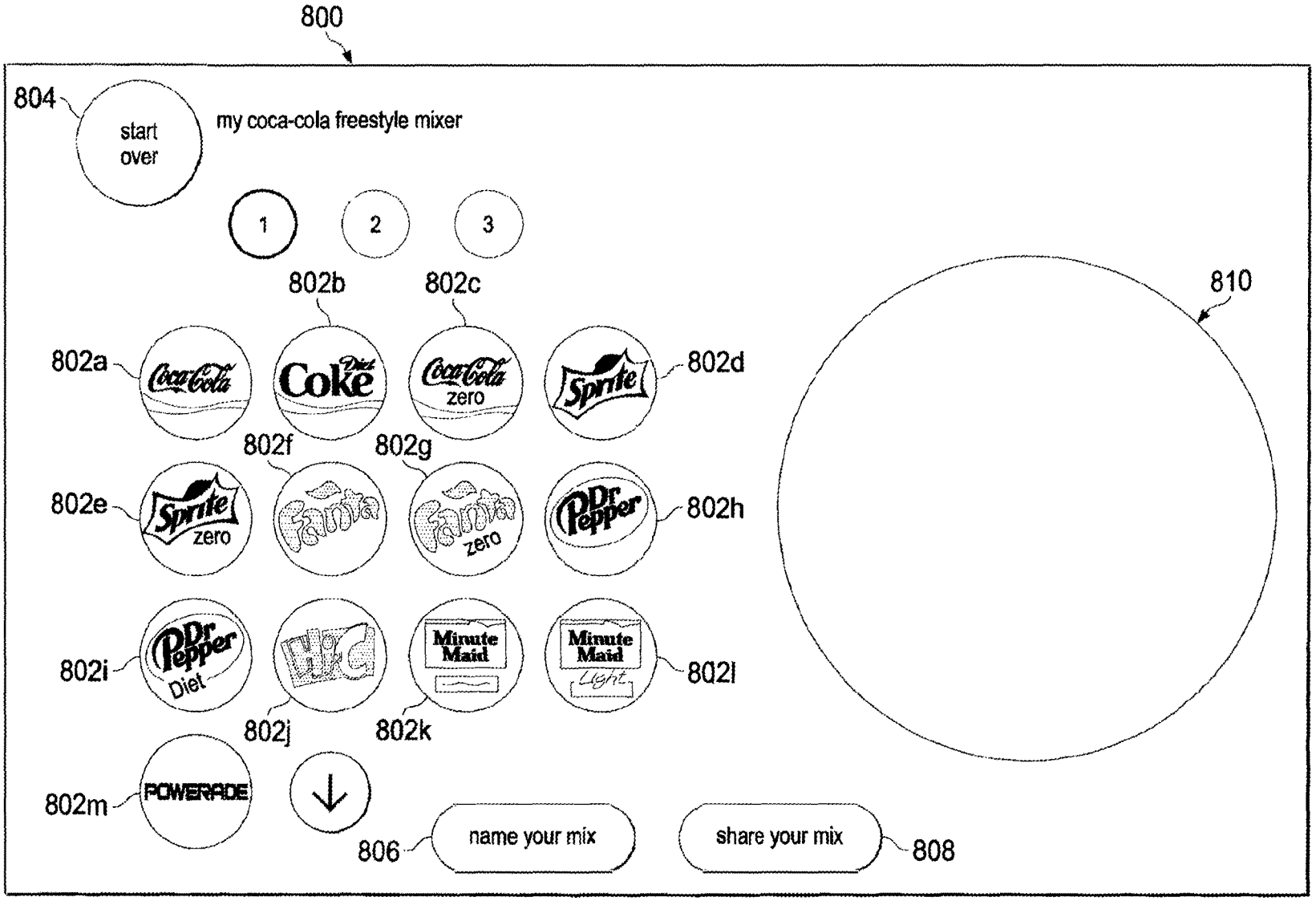
FIG. 8 is a screenshot of an illustrative user interface provides for a user to choose a consumable ingredient, in this case a beverage component, by selecting a first selectable indicia from a plurality of selectable indicia representative of consumable ingredient brands.

With regard to FIG. 8, a screenshot of an illustrative user interface 800 provides for a user to choose a consumable ingredient, in this case a beverage component, by selecting a first selectable indicia 802*a* from a plurality of selectable indicia 802*a*-802*m* (collectively 802) representative of consumable ingredient brands is shown. The user interface 800 may provide for alternative shapes, sizes, layouts, and so forth of the indicia 802. As previously described, the user interface 800 may be presented on a touchscreen that enables the user to select from the indicia 802 by touching and/or swiping the touchscreen. In an embodiment, a "start over" soft-button 804 may enable the user to start over in selecting one or more consumable ingredient. A "name your mix" soft-button 806 and "share your mix" soft-button 808 may enable the user to name and share a mixed consumable item after completing selection of consumable ingredients and setting mix percentages of the consumable ingredients to form a mixed consumable item ("mix"), as further described herein.

Figure 9:
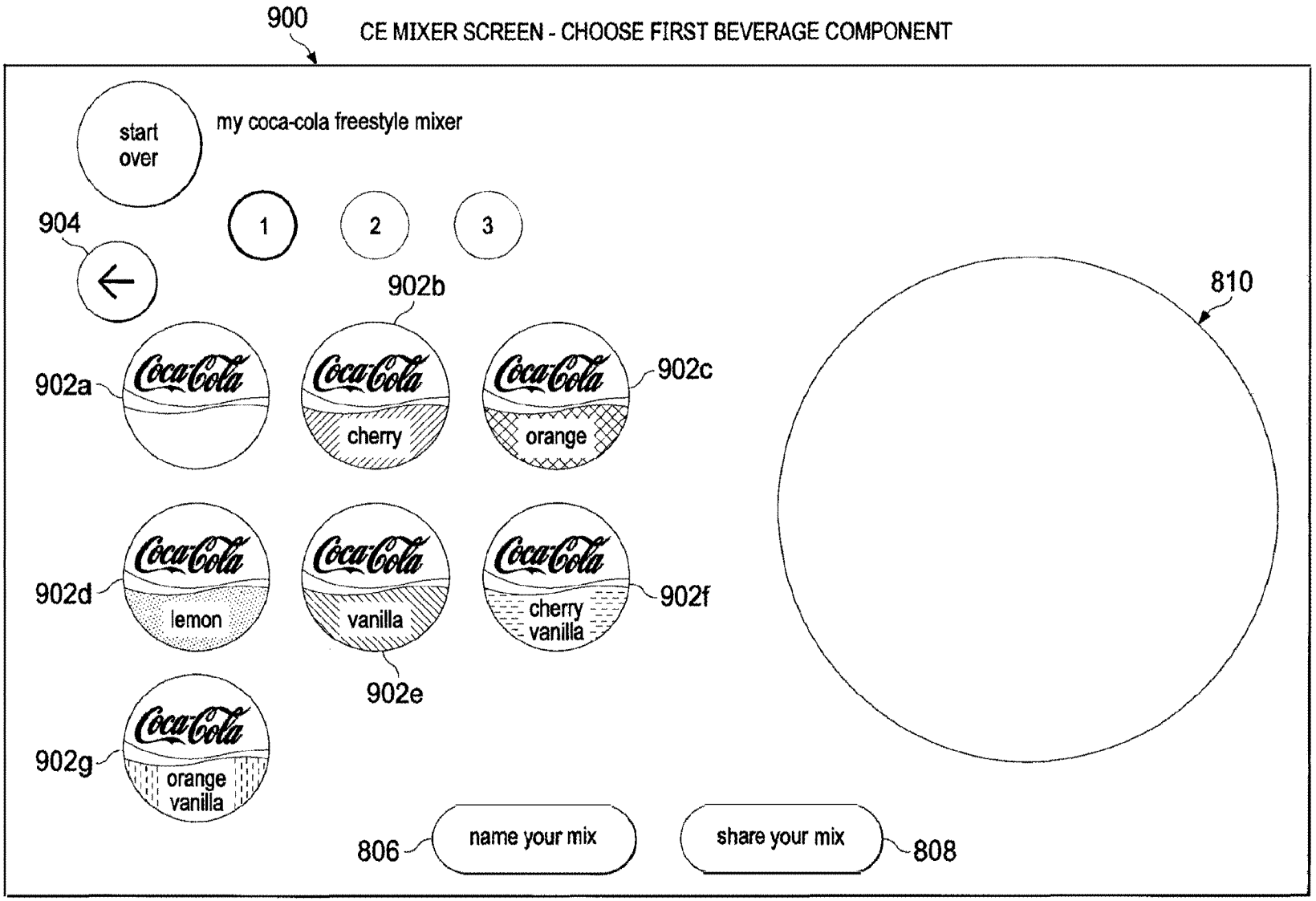
FIG. 9 is a screenshot of an illustrative user interface that provides for a user to choose a flavor presented in selectable indicia available for a selected consumable ingredient from the user interface of FIG. 8.

With regard to FIG. 9, a screenshot of an illustrative user interface 900 that provides for a user to choose a flavor presented in selectable indicia 902*a*-902*g* (collectively 902) available for a selected consumable ingredient from the user interface 800 of FIG. 8 is shown. In this case, the selected consumable ingredient is a particular brand of a beverage, and seven flavors available at a dispenser may be displayed in the selectable indicia 902 for the user to select. A "back" soft-button 904 may enable the user to navigate back to the user interface 800 for the user to select a different brand, if desired.

Figure 10:
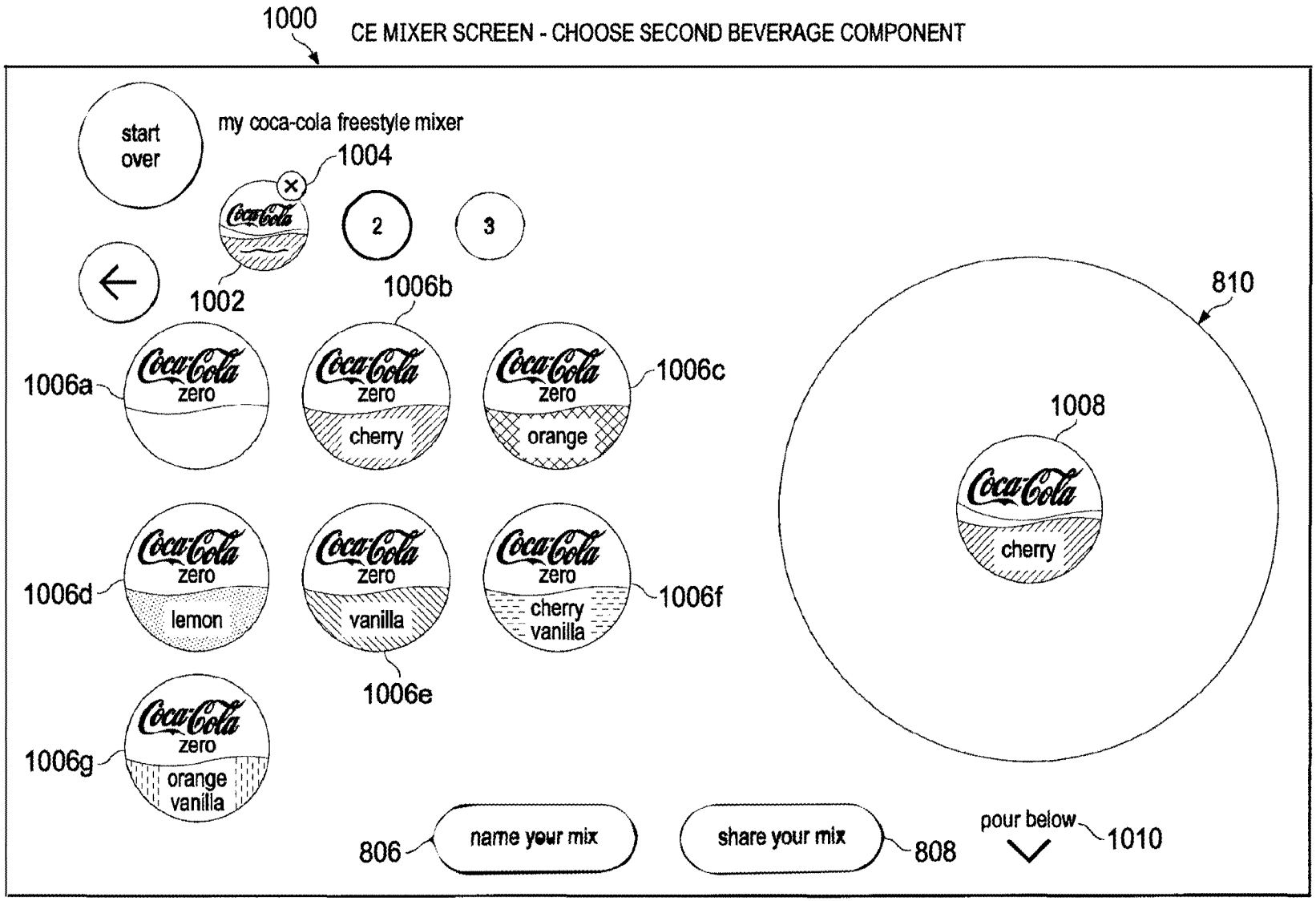
FIG. 10 is a screenshot of an illustrative user interface that provides for a user to choose a second consumable ingredient to mix with a first selected consumable ingredient as selected by the user using the user interface from FIG. 9.

With regard to FIG. 10, a screenshot of an illustrative user interface 1000 that provides for a user to choose a second consumable ingredient to mix with a first selected consumable ingredient as selected by the user using the user interface 900 from FIG. 9 is shown. A first indicia 1002 is shown to be inclusive of information indicative of a selection of a consumable ingredient (e.g., brand and flavor of the consumable ingredient). Along with the indicia 1002 is a "delete" user interface element 1004, in this case an "x," that allows a user to delete the selected consumable ingredient. Additionally, selectable indicia 1006*a*-1006*g* (collectively 1006) may be displayed for the user to select another brand and/or flavor of the brand for mixing with the consumable ingredient displayed in indicia 1002. As shown, the flavors of the brand, in this case Coca-Cola® Zero, are individually displayed in the indicia 1006 and are selectable. The selected consumable items pie chart 810 is shown to include consumable ingredient indicia 1008 that matches the previously selected consumable ingredient indicia 902*b* from FIG. 9 to notify the user that a consumable item with that consumable ingredient, in this case regular Coca-Cola® Cherry, is available to be dispensed, at this point one-hundred percent without another consumable ingredient selected to be mixed with the Coca-Cola® Cherry ingredient. If the user desires to have only regular Coca-Cola® Cherry dispensed, then the user may select a "pour below" soft-button 1008, for example. It should be understood that alternative mechanisms, such as a pushbutton (not shown), may be utilized to dispense the consumable item as provided in the consumable items pie chart 810, as further shown herein. As the user selects additional consumable ingredients and flavors of the consumable ingredients, additional indicia is displayed in the consumable item pie chart 810 for the user to select or set percentages of each of the consumable ingredients to be mixed to form a mixed consumable item.

Figure 11:
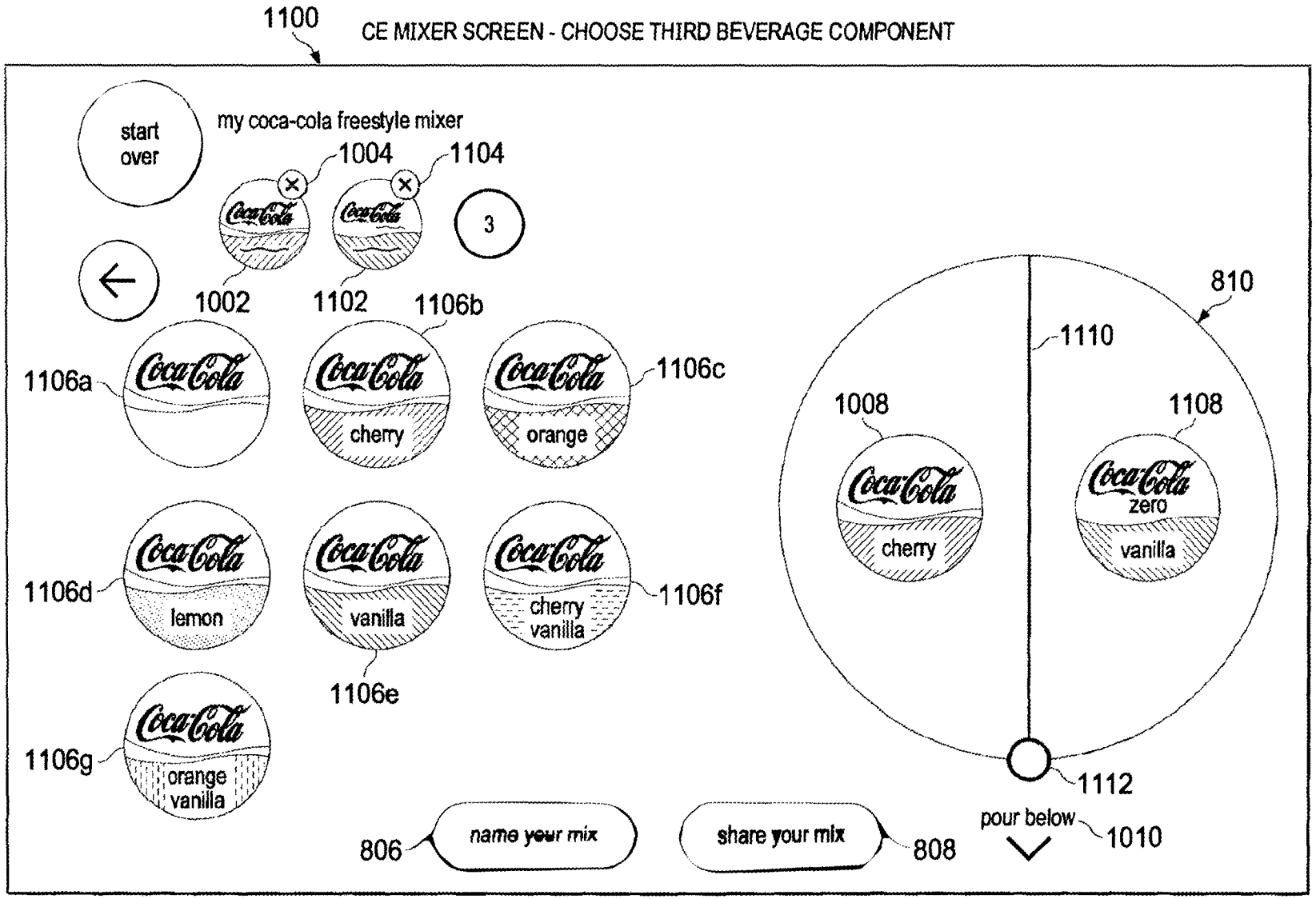
FIG. 11 is a screenshot of an illustrative user interface that provides for a user to choose a third consumable ingredient to mix with the first and second selected consumable ingredients as selected by the user using the user interfaces of FIG. 9 and FIG. 10.

With regard to FIG. 11, a screenshot of an illustrative user interface 1100 provides for a user to choose a third consumable ingredient to mix with the first and second selected consumable ingredients as selected by the user using the user interfaces 900 of FIGS. 9 and 1000 of FIG. 10 is shown. A second indicia 1102 that matches the consumable ingredient indicia 1006*c* of FIG. 10 selected by the user may be displayed. Along with the indicia 1102 is a delete user interface element 1104, in this case, and "x," that allows the user to delete the selected second consumable item. Additionally, indicia 1106*a*-1106*g* (collectively 1106) may be displayed for the user to select a third brand and/or flavor of the brand for mixing with the selected consumable ingredients displayed in indicia 1002 and 1102. The pie chart 810, in response to the user selecting the second consumable ingredient, in this case Coca-Cola Zero® Vanilla, may display the indicia 1008 and 1108 along with a proportion line 1110 that indicates that the proportion of the consumable item shown in indicia 1008 and 1108 is 50% of each. In an embodiment, a default of the proportion line 1110 may be 50/50. A user interface control element 1102, in this case a circle positioned on a perimeter of the pie chart 810, may enable the user to adjust proportions of each of the consumable items shown in the indicia 1008 and 1108. In the event of having only two selected consumable items, one end of the proportion line 1110 may remain fixed, while the user interface control element 1112 may be repositionable, such that the proportions may be altered from 50/50 of each of the consumable ingredients. The proportions may be altered by integers or fractions. If the user is ready to test or dispense the consumable item established by the consumable ingredients and proportions thereof shown in the indicia 1008 and 1108 in the pie chart 810, then the user may engage the "pour below" soft-button 1010 to begin mixing and dispensing the consumable ingredients into a beverage cup or otherwise. It should be understood that in the event that the consumable ingredients are not liquid, then other wording (e.g., "add toppings") may be used for dispensing the mixed consumable item.

Figure 12:
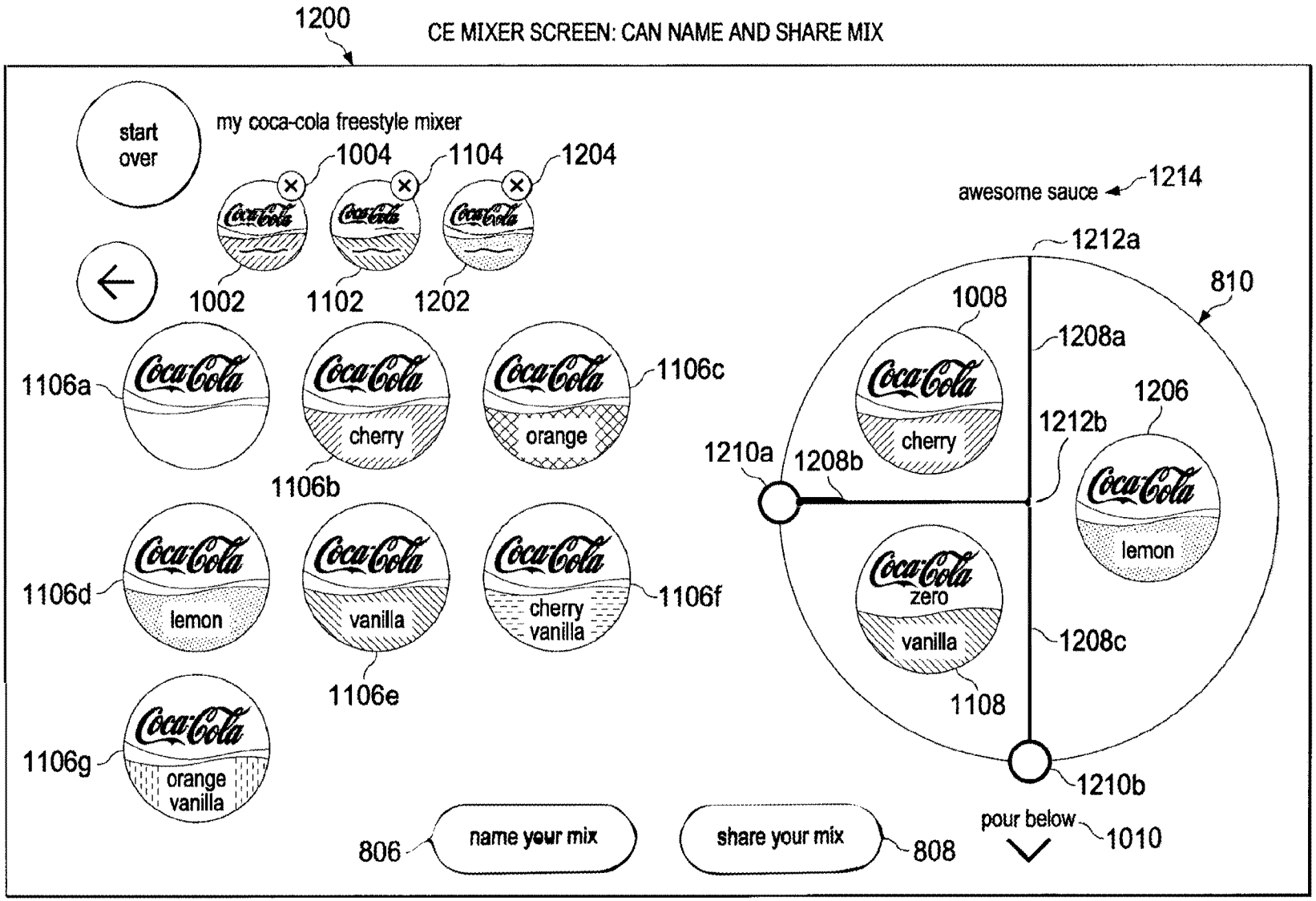
FIG. 12 is a screenshot of an illustrative user interface that provides for displaying information of the three selected consumable ingredients in respective indicia.

With regard to FIG. 12, a screenshot of an illustrative user interface 1200 provides for displaying information of the three selected consumable ingredients in respective indicia 1002, 1102, and 1202 is shown. The user may be provided the ability to delete or remove any of the consumable ingredients by using user interface control elements 1004, 1104, and 1204. The pie chart 810 is shown to include the third selected consumable ingredient, in this case Coca-Cola® Lemon, in indicia 1206 responsive to the user selecting consumable ingredient indicia 1106*d* in FIG. 11 along with the previously selected consumable ingredients shown in the indicia 1008 and 1108. As shown, three proportion line segments 1208*a*, 1208*b*, in 1208*c* may be displayed on the pie chart 810 so as to divide proportions of each of the consumable ingredients in a graphical manner. The proportion line segments 1208*a* and 1208*c* extend vertically relative to one another, thereby showing that the Coca-Cola® Lemon consumable ingredient identified in the indicia 1206 is to be 50% of a mixed consumable item with each of the Coca-Cola® Cherry and Coca-Cola® Vanilla consumable ingredients being 25% as defined by the proportion line segment 1208*b*. As further shown, user interface control elements 1210*a* and 1210*b* may enable the user to change mixed proportions of the three selected consumable items, as desired. It is noted that the proportion line segment 1208*a* is fixed between a first end of point 1212*a* and the center point 1212*b*. Because the user interface 1200 may be displayed on a touchscreen, the user may use his or her finger to rotate the user interface control elements 1210*a*-1210*b*, as desired. It should be understood that alternative user interface control elements may be utilized to adjust proportions of the consumable ingredients that are selected to be part of a mixed consumable item. In response to the user selecting the "name your mix" soft-button 806, the user may be presented with a keyboard user interface (see FIG. 17, for example) that enables user to type his or her mix name 1214 and/or other information. The mix name 1214 may be displayed above the pie chart 810 or anywhere else on the user interface 1200.

Figure 13:
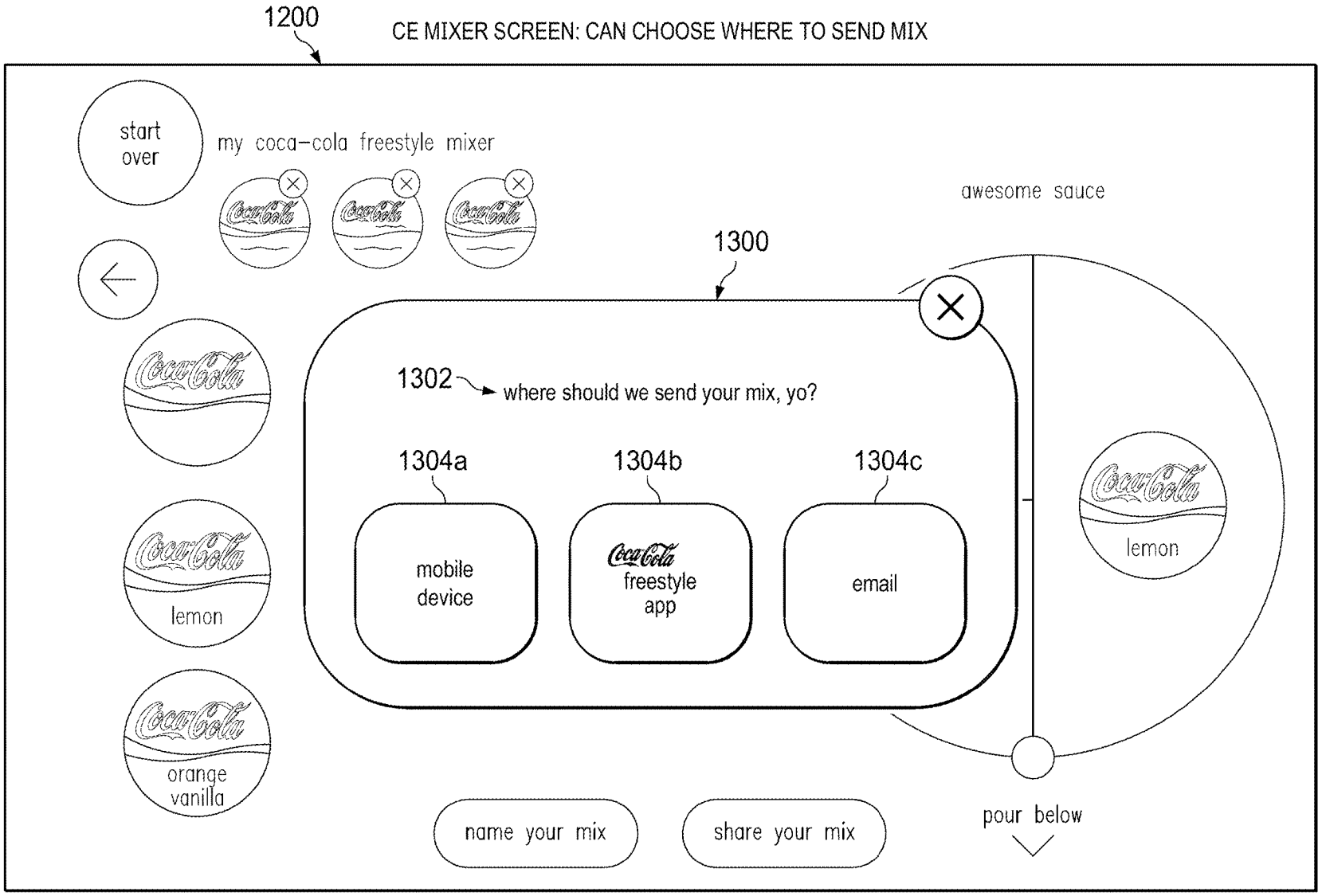
FIG. 13 is a screenshot inclusive of a pop-up window that may be displayed in response to the user selecting the "share your mix" soft-button on any of the preceding user interfaces of FIGS. 8-12, respectively.

With regard to FIG. 13, a screenshot inclusive of a pop-up window 1300 may be displayed in response to the user selecting the "share your mix" soft-button 808 on any of the preceding user interfaces 800-1200 of FIGS. 8-12, respectively. A message 1302 may ask the user where he or she would like to send the mix along with three selectable soft-buttons 1304*a*, 1304*b*, and 1304*c*. The soft-buttons 1304*a*-1304*c* may enable the user to send the mix to a mobile device 1304*a* via a short message service (SMS) message or text message, mobile app that may be executed on a mobile device of the user, or email address of the user. It should be understood that alternative network addresses (e.g., Facebook®, Goggle®) may be available for the user to communicate the mix, which may include a mix code representative of the mix. A network address may be any electronic address (e.g., phone number, user ID, email address, etc.) at which a user may access a message or communication directly (e.g., text message at a mobile device), via an application (e.g., web-based application, mobile app), or otherwise. In an embodiment, the mix may be communicated, including a name of the mix as created by the user or system being used by the user to create the mix along with ingredients and percentages of ingredients used to form the mixed consumable item. In an embodiment, a mix code may be created from the one or more consumable items and percentages of the consumable items that form the mixed consumable item.

Figure 14:
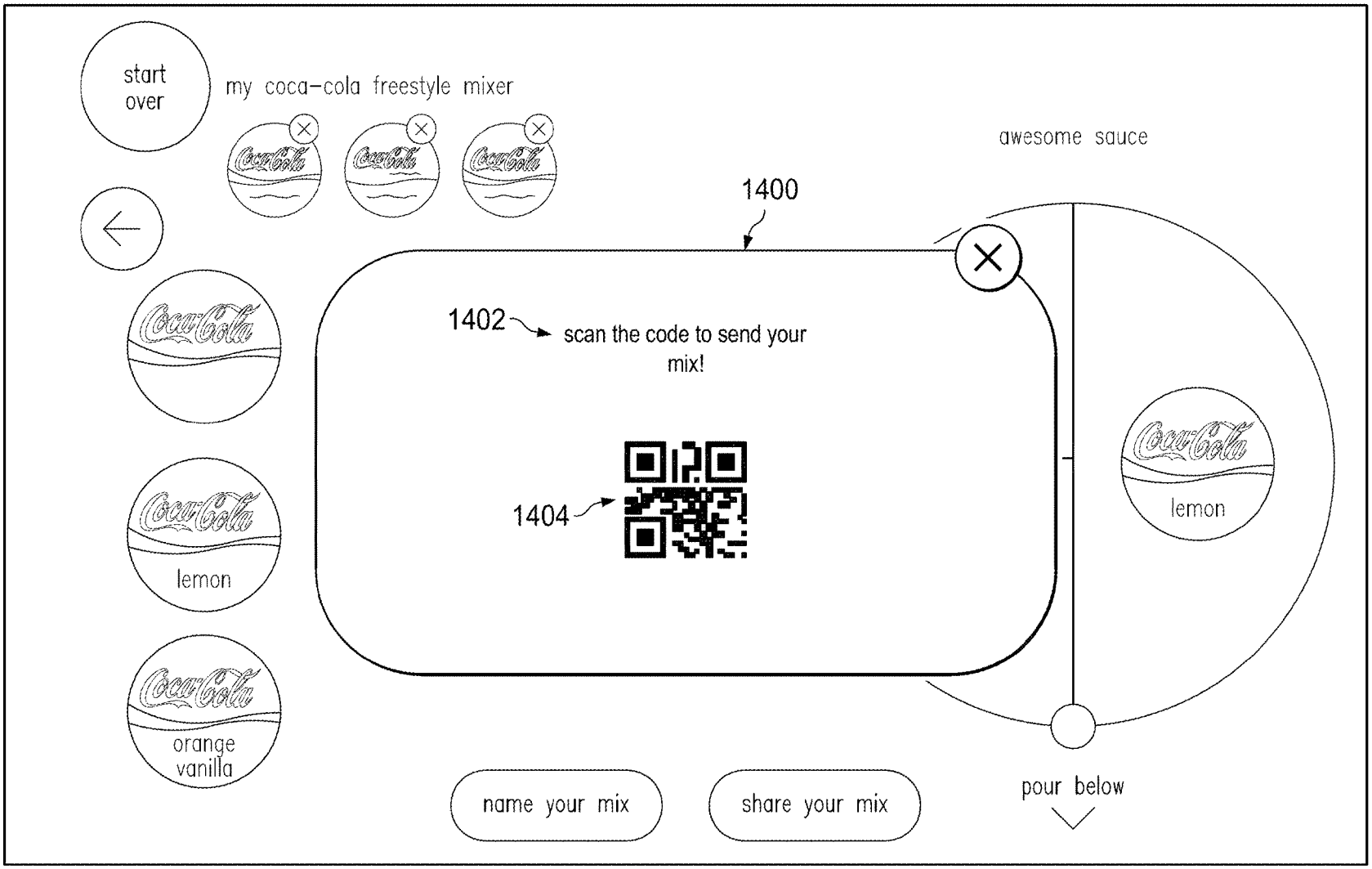
FIG. 14 is a screenshot inclusive of a pop-up window that may be displayed that includes a message along with a machine readable indicia, such as a QR code, barcode, or any other machine readable code that may be readable by a mobile electronic device, such as a smartphone of a user.

With regard to FIG. 14, a pop-up window 1400 may be displayed that includes a message 1402 along with a machine readable indicia 1404, such as a QR code, barcode, or any other machine readable code that may be readable by a mobile electronic device, such as a smartphone of a user, is shown. The pop up window 1400 may be displayed in response to the user using a mobile app being executed on a mobile device of the user. Using a mobile app, the indicia 1404 may be scanned, which, in turn, may cause the mobile app to communicate the mix code to send to an online account, friend, or elsewhere.

Figure 15:
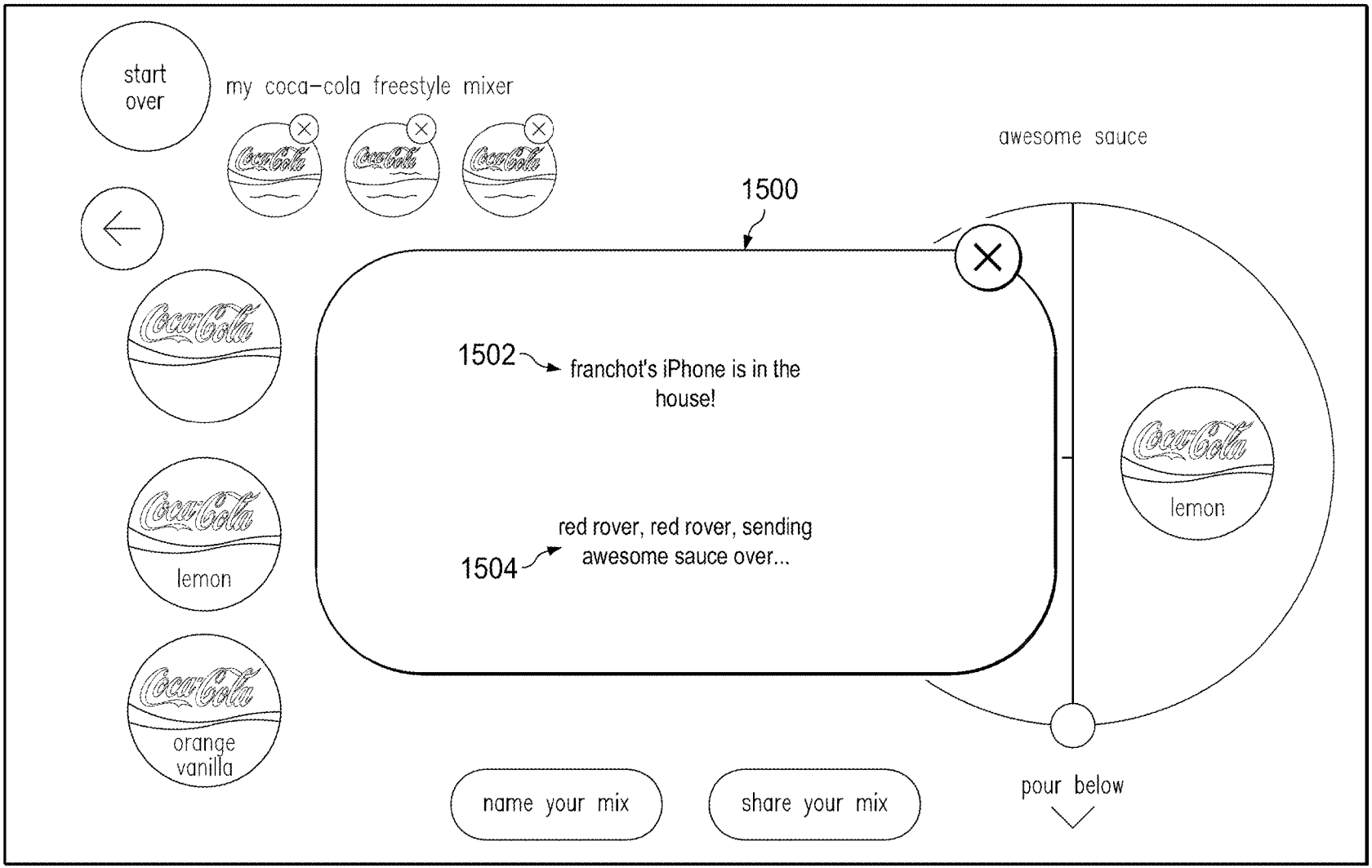
FIG. 15 is a screenshot that includes a pop-up window that may be displayed that includes a message that indicates that a user's mobile electronic device is geographically located near the dispenser.

With regard to FIG. 15, a screenshot that includes a pop-up window 1500 may be displayed that includes a message 1502 that indicates that a user's mobile electronic device is geographically located near the dispenser is shown. In an embodiment, a local communications path, such as via Bluetooth®, Wi-Fi®, ultra wide band (UWB) radio frequency, or other communications protocol, may be used to recognize proximity and/or relative location of the mobile electronic device. As indicated by message 1504, the dispenser may communicate the mix name ("awesome sauce") to the mobile device of the user via the communications path established between the dispenser and mobile device.

Figure 16:
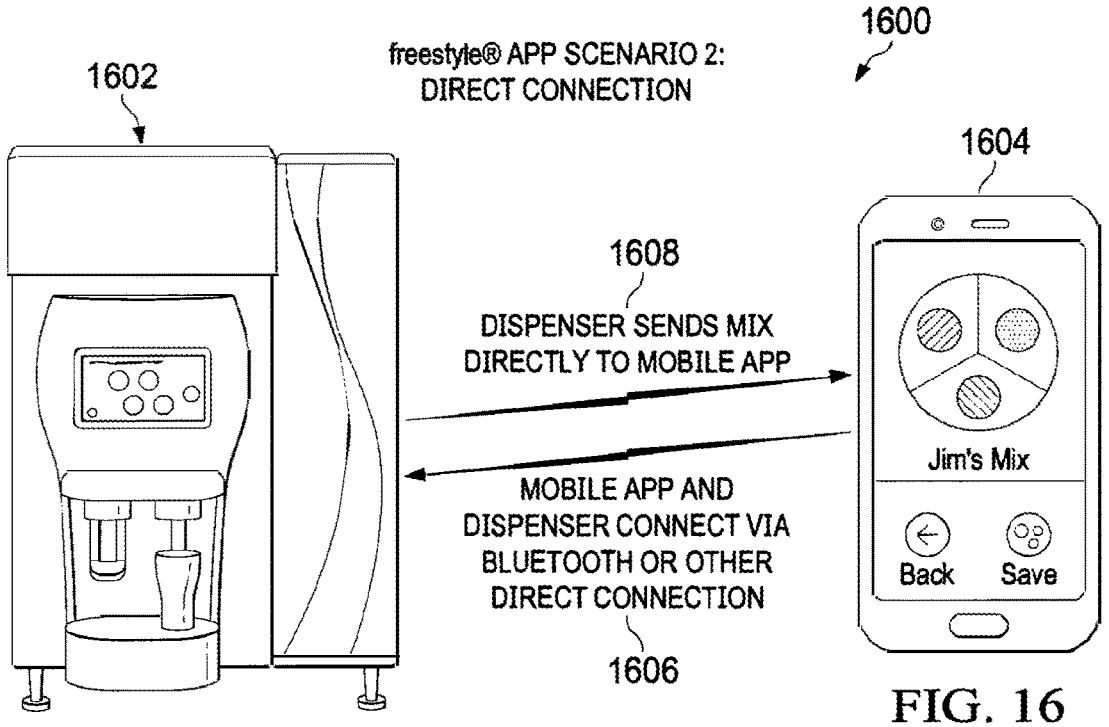
FIG. 16 is an illustration of the illustrative dispenser environment that includes a dispenser that may be in communication with a mobile device via a short range communications protocol, such as Bluetooth® or other direct path communications protocol.

With regard to FIG. 16, an illustration of the illustrative dispenser environment 1600 that includes a dispenser 1602 that may be in communication with a mobile device 1604 via a short range communications protocol, such as Bluetooth® or other direct path communications protocol is shown. In an embodiment, the mobile device 1604 may execute a mobile app using a processing unit on the mobile device 604, as understood in the art. In operation, at step 1606, the mobile app and dispenser may wireless connect by the mobile app 604 using a Bluetooth® or other communications protocol on the mobile device 1604 to perform a handshake with a communications circuit (not shown) operating in the dispenser 1602. In an alternative embodiment, the dispenser 1602 may initiate communications with the mobile device 1604. After the dispenser 1602 and mobile device 1604 are in communication with one another, the mobile app 1604 may send a query or command to the dispenser 1602 to request a mix created by the user. Responsive to the query or other communication, the dispenser 1602 may communicate a mix in the form of a mix code or other format directly to the mobile app operating on the mobile device 1604. The mix may be in the form of a mix code, but may also include other information, such as a description of the consumable ingredients and percentages thereof. Moreover, a name of the mix may be communicated from the dispenser 1602 to the mobile app being executed on the mobile device 1604.

Figure 17:
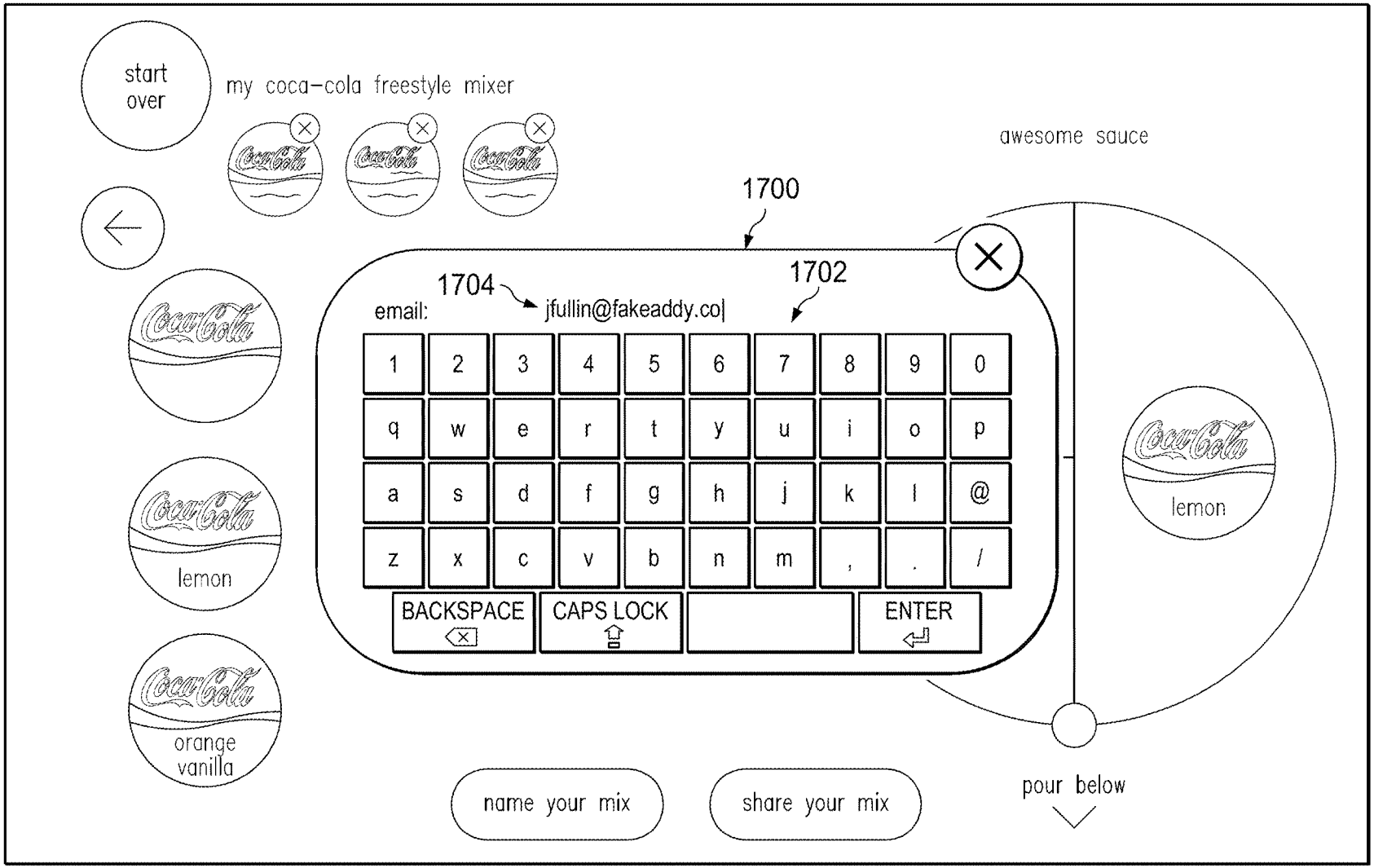
FIG. 17 is an illustration of the illustrative pop-up window inclusive of illustrative soft-keyboard that a user may use to type his or her email address for communicating the mix and responsive to the user selecting the "email" soft-button in FIG. 13.

With regard to FIG. 17, an illustration of the illustrative pop-up window 1700 inclusive of illustrative soft-keyboard 1702 that a user may use to type his or her email address 1704 for communicating the mix and responsive to the user selecting the "email" soft-button 1304*c* in FIG. 13 is shown. The user may type his or her email address into the soft-keyboard 1702, and the dispenser may thereafter generate the mix code of the consumable ingredients and percentages thereof that form the mixed consumable item and communicate the mix, inclusive of the mix code, mix name, ingredients, and percentage of ingredients, for example, to the email address entered by the user.

Figure 18:
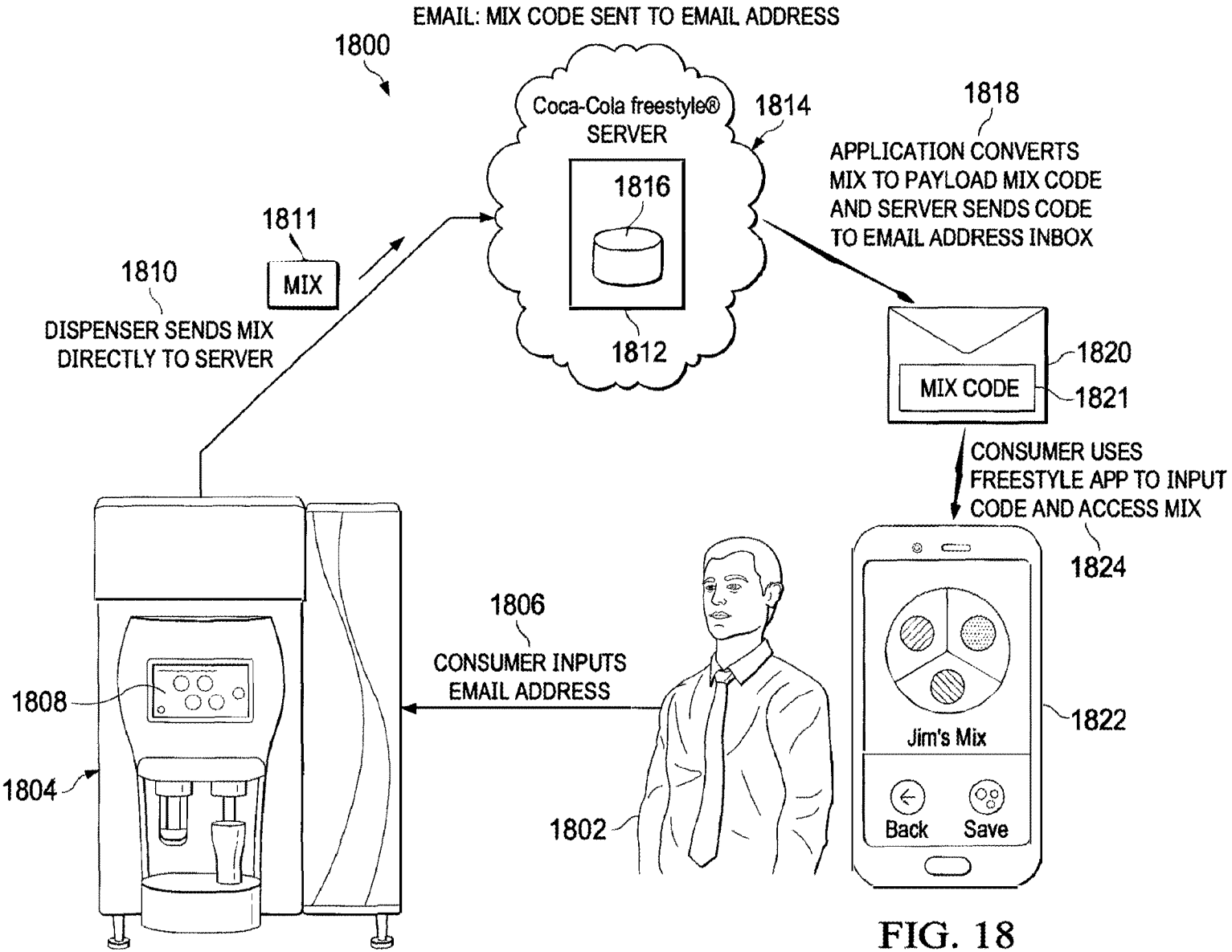
FIG. 18 is an illustration of illustrative dispenser environment in which a user uses dispenser to produce a mixed consumable item.

With regard to FIG. 18, an illustration of illustrative dispenser environment 1800 in which a user 1802 uses dispenser 1804 to produce a mixed consumable item is shown. At step 1806, the user 1802 may include his or her email address, as provided in FIGS. 13 and 17, into a user interface 1808 of the dispenser 1804. At step 1810, the dispenser 1804 may communicate a mix 1811 to a server 1812 operating in a communications network (a "cloud" server). The server 1812 may store the mix 1811 in a data repository 1816. At step 1818, an application being executed by the server 1812 may convert the mix ingredients and percentages thereof into a mix code 1821, such as an alphanumeric value, that defines the consumable ingredients and percentages thereof that form the mixed consumable item. Further at step 1818, the server 1812 may email the mix code 1821 via an email 1820 using an email communications protocol that is sent to an electronic device 1822 or any other email address from which the electronic device 1822 may access. In an embodiment, the electronic device 1822 may be executing a mobile app that operates in conjunction with the dispenser 1804 that is able to open the email 1820 and receive and access the mix code 1821 for storage and use thereby. In an embodiment, the mobile app being executed on the electronic device 1822 may be communicated to the dispenser 1804 or any other dispenser (not shown) at any later point in time, such that the dispenser 1804 may generate the mix 1811 for the user to dispense thereat.

Figure 19:
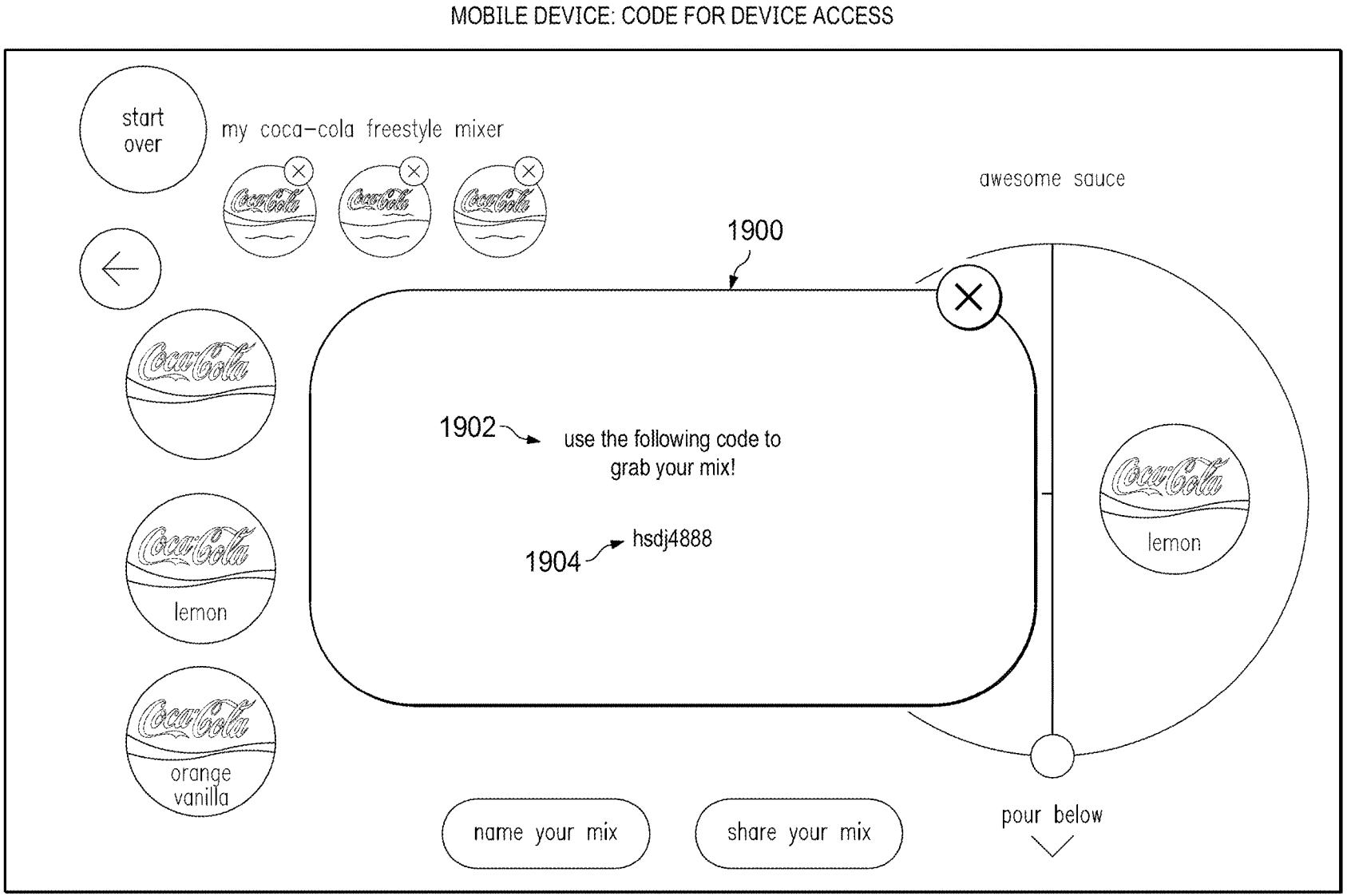
FIG. 19 is an illustration of an illustrative pop-up window that is shown to include a message that notifies the user to use a mix code for producing and dispensing his or her mixed consumable item.

With regard to FIG. 19, an illustration of an illustrative pop-up window 1900 is shown to include a message 1902 that notifies the user to use a mix code 1904 for producing and dispensing his or her mixed consumable item is shown. The mix code 1904 is shown to be formed of an alphanumeric value that identifies consumable ingredients and percentages thereof that are used to form a mixed consumable item as set by the user using the dispenser to create the mix. In an alternative embodiment, the mix may have been created by a user using his or her electronic device, such as a mobile phone, that executes a mix app. However, as previously described, using the dispenser to create a mix enables the user to test the mix in real time, thereby allowing the user to achieve a desired mix of a consumable item faster and more efficiently than otherwise.

Figure 20:
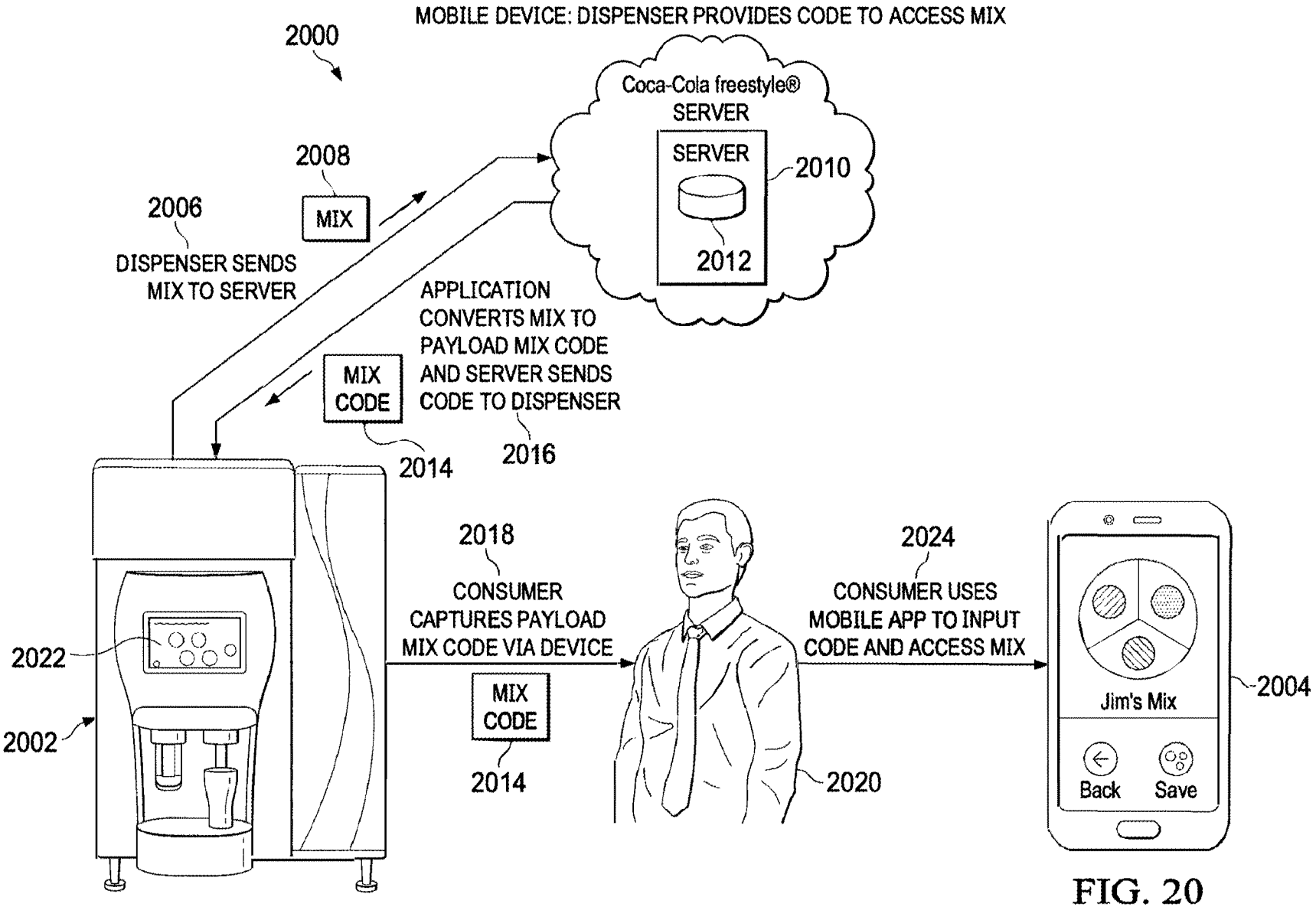
FIG. 20 is an illustration of an illustrative dispenser environment shown to include a dispenser that provides a mix code to a user of a mobile device.

With regard to FIG. 20, an illustration of an illustrative dispenser environment 2000 is shown to include a dispenser 2002 that provides a mix code to a user of a mobile device 2004. In an embodiment, at step 2006, the dispenser 2002 may communicate a mix 2008 to a server 2010. The mix 2008 may include information, such as brands, flavors of brand, names of consumable items, name of mix, percentages of consumable items, and so forth. The server 2010 may execute an application 2012 formed of machine-readable instructions that, when executed by the processing unit of the server, may convert the mix 2008 into a mix code 2014 that is sent back to the dispenser 2002 at step 2016. The dispenser 2002 may receive the mix code 2014, and communicate the mix code 2014 to a user 2020 via the electronic device 2004. In communicating the mix code 2014, the dispenser 2002 may display an indicia (see, for example, FIG. 14) on a user interface 2022 for the user to see, image, or scan by the electronic device 2004 executing the mobile app at step 2024 thereby.

Figure 21:
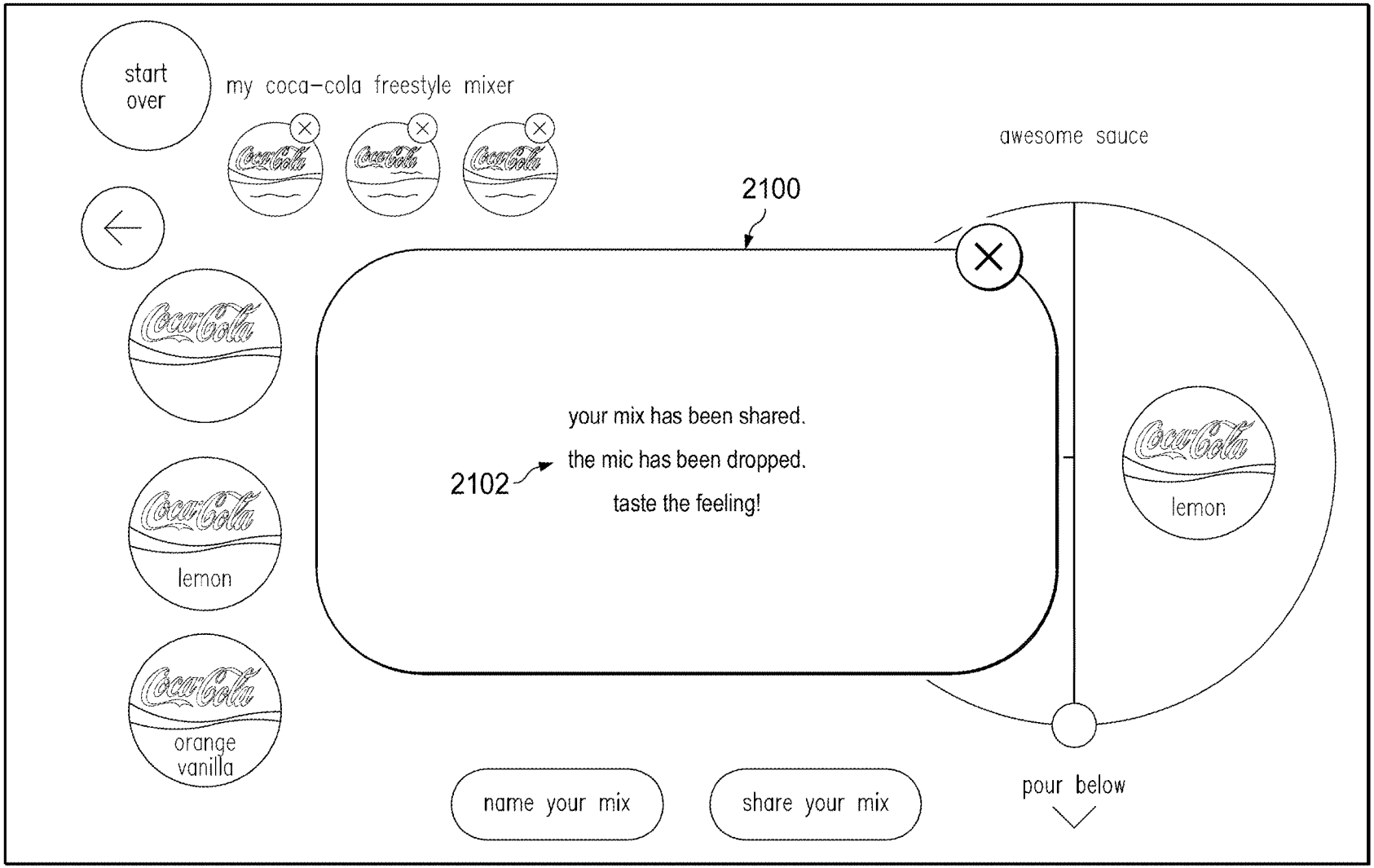
FIG. 21 is an illustration of an illustrative pop-up window shown to include a message that notifies the user that his or her mix has been shared.

With regard to FIG. 21, an illustration of an illustrative pop-up window 2100 is shown to include a message 2102 that notifies the user that his or her mix has been shared. The pop-up window 2100 may be displayed as confirmation in response to a user sharing a mix by selecting the "share your mix" soft-button 808 and sending the mix to one or more friends and family via the dispenser.

Figure 22:
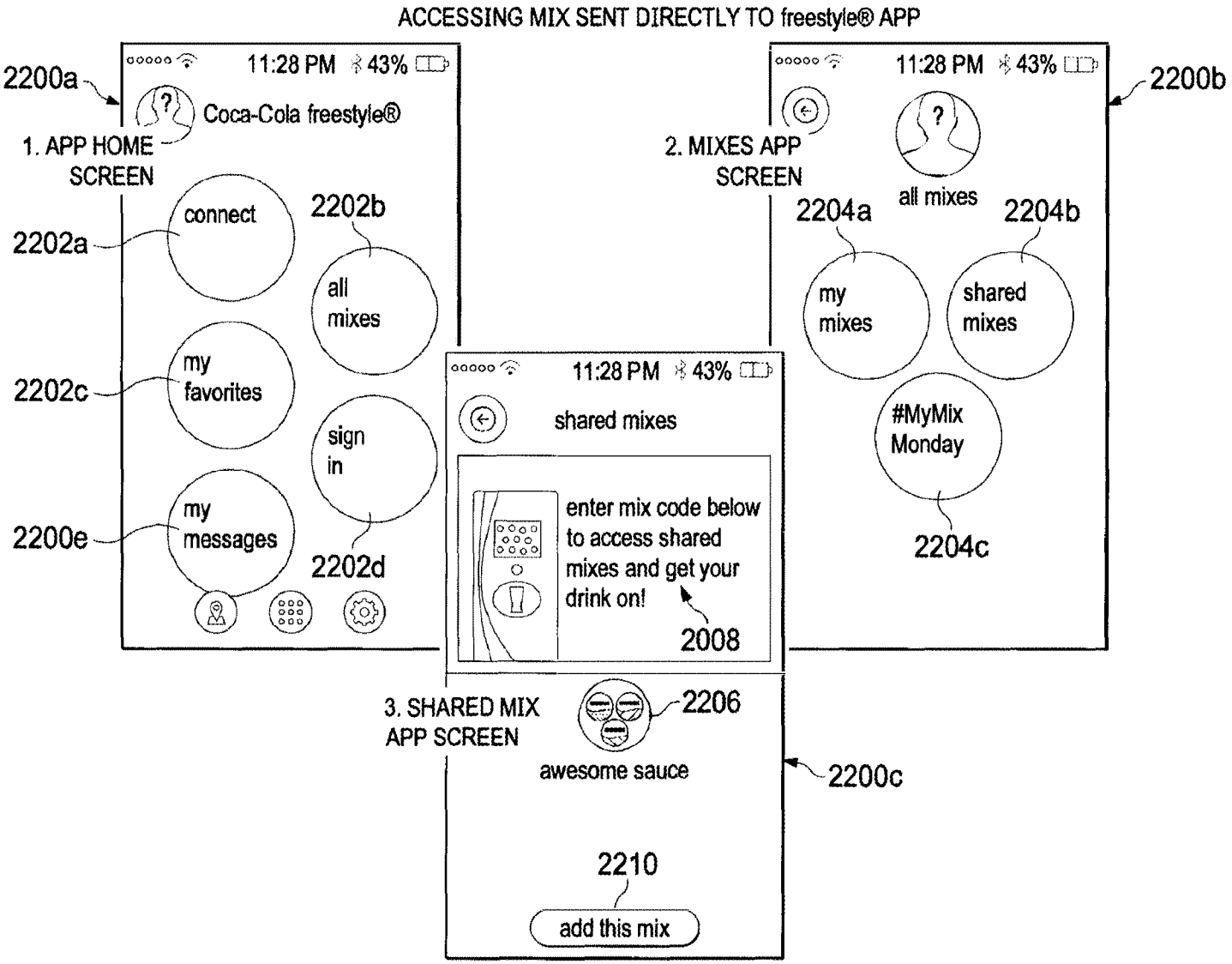
FIG. 22 is a set of screenshots inclusive of a home screen user interface, mixes app screen user interface, and shared mix app screen user interface of a mobile app used on a mobile device, such as a smartphone.

With regard to FIG. 22, a set of screenshots inclusive of a home screen user interface 2200*a*, mixes app screen user interface 2200*b*, and shared mix app screen user interface 2200*c* (collectively 2200) of a mobile app used on a mobile device, such as a smartphone, are shown. The home screen user interface 2200 is illustrative of a mobile app home screen that includes a number of soft-buttons, including a "connect" soft-button 2202*a*, "all mixes" soft-button 2202*b*, "my favorites" soft-button 2202*c*, "sign in" soft-button 2202*d*, and "my messages" soft-button 2200*e*.

In response to a user selecting the "all mixes" soft-button 2202*b*, the mobile app displays the mixes app screen user interface 2200*b*. The mixes app screen user interface 2200*b* includes a "my mixes" soft-button 2204*a*, "shared mixes" soft-buttons 2204*b*, and "#MyMix Monday" soft-button 2204*c* such that the user of the mobile app may access the various mixes, including the user's mixes, mixes that are shared with others or others have shared with the user, and a mix that the user enjoys on Monday. Other features, such as top mixes, mix trends, friends' mixes, or other mixes may be available to the user, and the mix codes may be automatically stored on the mobile device or otherwise accessible in the cloud or otherwise via the mobile app.

In response to the user selecting the "shared mixes" soft-button 2204*b*, the mobile app displays the shared mix app screen user interface 2200*c*. In the user interface 2200*c*, the "awesome sauce" mix soft-button 2206 associated with a mix that the user created along with any other mix that other users may have created and shared with the user of the mobile app may be displayed in an indicia or listing that may function as a soft-button. In an embodiment, a message 2208 displayed on the user interface 2200*c* may instruct the user to enter a mix code (not shown) into a dispenser for the dispenser to automatically be configured to create the mix associated with the mix code. In an embodiment, the mix code may be displayed in response to the user selecting the "awesome sauce" soft-button 2206. In another embodiment, selection of the "awesome sauce" soft-swype button 2206 may initiate a communication with a dispenser to communicate the mix code thereto so that the user does not have to type in the mix code. The communication may be a local communication (e.g., Bluetooth®), remote communication via a cloud server, or otherwise. An "add this mix" soft-button 2210 may be selected to enable the user to add the "awesome sauce" mix to his or her mixes that may be accessible via the "my mixes" soft-button 2204*a*.

Figure 23:
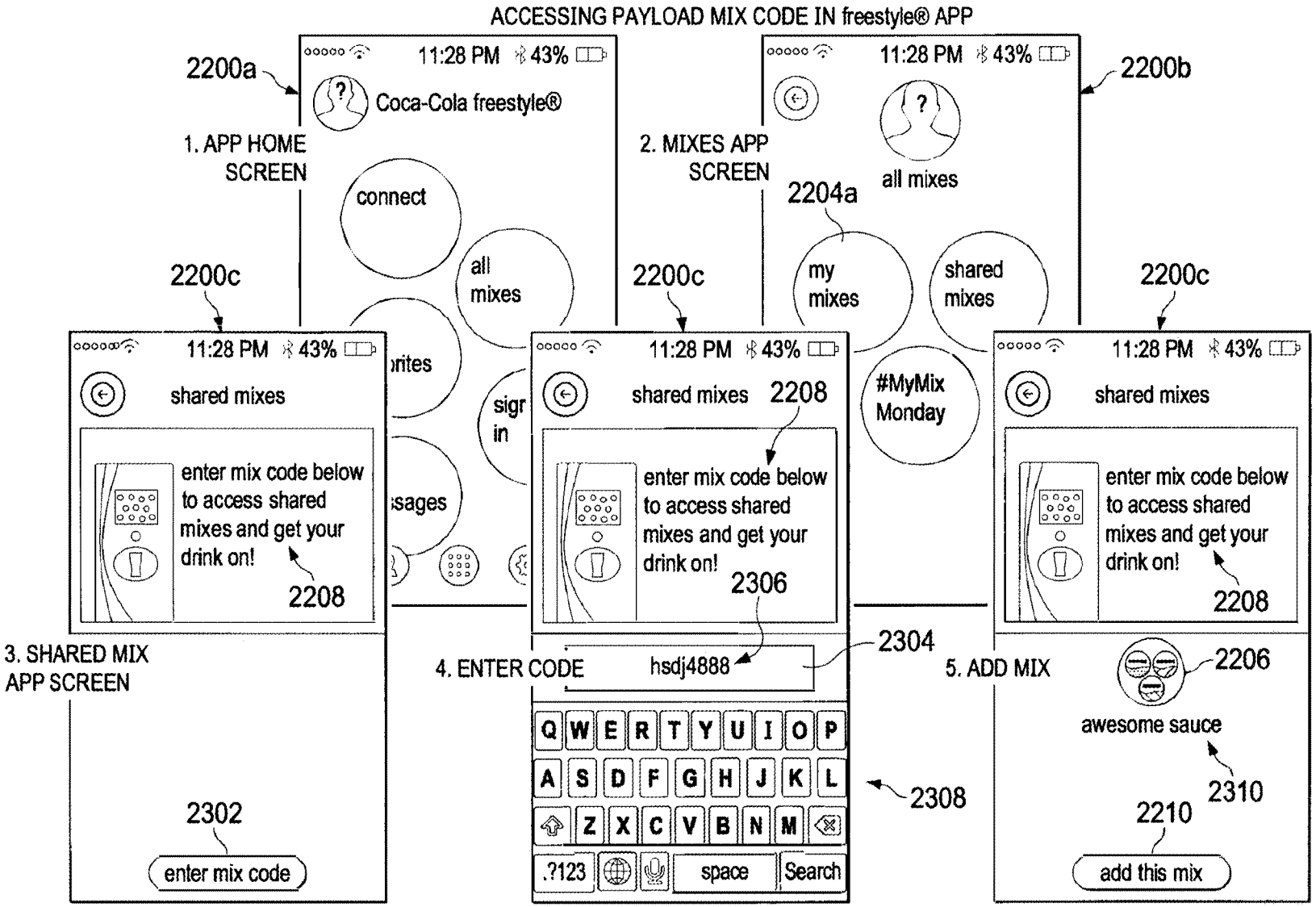
FIG. 23 is a set of screenshots showing the homepage user interface, mixes app screen user interface, and shared mixed app screen user interface.

With regard to FIG. 23, a set of screenshots showing the homepage user interface 2200*a*, mixes app screen user interface 2200*b*, and shared mixed app screen user interface 2200*c* are shown. With regard to the shared mix app screen user-interface 2200*c*, the user may select an "enter mix code" soft-button 2302 that causes the mobile app to display a text entry field 2304 for the user to enter a mix code 2306 using a soft-keyboard 2308. In response to the user entering the mix code 2306, the mobile app may access the mix in a memory of the mobile device via a dispenser of consumable items (e.g., soft drinks) or server in communication with the dispenser at which the mix was created, and generate the "awesome sauce" soft-button 2206 that displays a mix name 2310. The user made thereafter select the "add this mix" soft-button 2210 to add the mix to his or her mixes stored by the mobile app in the memory of the mobile device that are accessible via of the mixes app screen user interface 2200*b* by selecting the "my mixes" soft-button 2204*a*.

Figure 24:
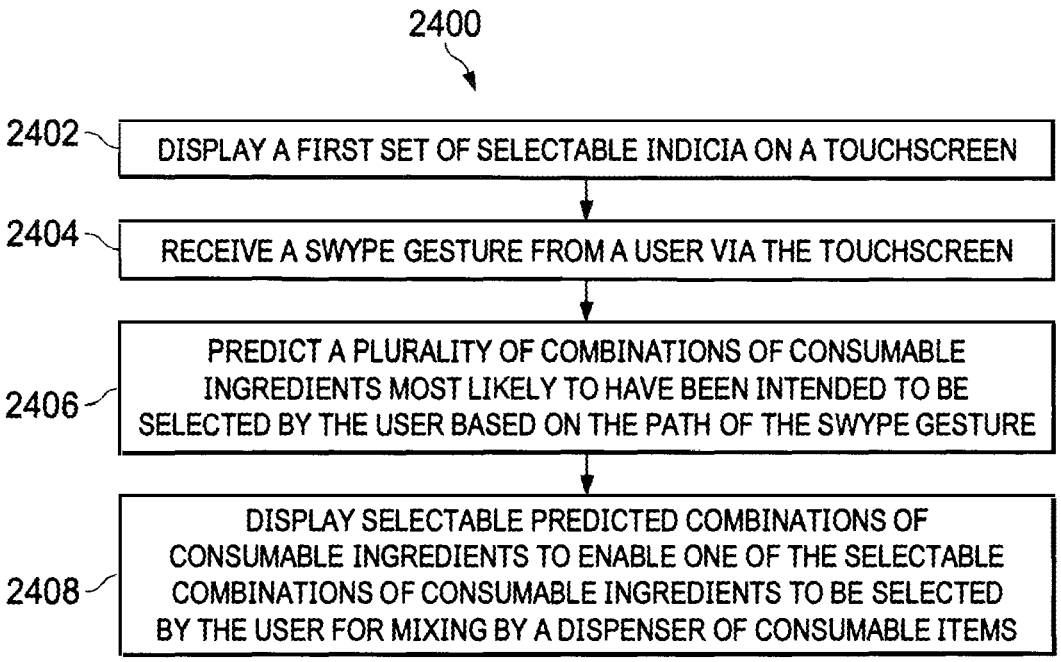
FIG. 24 is a flow diagram of an illustrative process for creating a mixed consumable item.

With regard to FIG. 24, a flow diagram of an illustrative process 2400 for creating a mixed consumable item is shown. The process 2400 may start at step 2402, where a first set of selectable indicia may be displayed on a touchscreen. The indicia may be (i) indicative of respective consumable ingredients and (ii) distinctly positioned relative to one another. At step 2404, a swype gesture may be received from a user via the touchscreen that forms a path extending between a first position and a second position that touches or passes close to at least two of the selectable indicia. From the first set of consumable ingredients, a plurality of combinations of consumable ingredients most likely to have been intended to be selected by the user based on the path of the swype gesture may be predicted at step 2406. At 2408, selectable predicted combinations of consumable ingredients may be displayed on the touchscreen to enable one of the selectable combinations of consumable ingredients to be selected by the user for mixing by a dispenser of consumable items.

Moreover, responsive to receiving the selected predicted combination of consumable ingredients, the user may be enabled to cause the mixed consumable items to be dispensed via the dispenser of consumable items. A user interface may be displayed on the touchscreen with adjustable display elements to enable the user to set relative amounts of the selected consumable ingredients to be mixed. An electronic device on which the touchscreen is operating may communicate a mix code that describes the selected predicted combination of consumable ingredients to the dispenser, where the mix code may cause the dispenser to display the selected predicted consumable ingredients and relative amounts thereof set by the user. The user may be enabled to select a dispenser to communicate the selected predicted combination of consumable ingredients for mixing thereby. The selected predicted combination of consumable ingredients may be stored in a temporary database to enable the user to alter the relative amounts of the selected predicted consumable ingredients set by the user for a predetermined period of time.

In an embodiment, a first set of selectable indicia being displayed may include displaying, on the touchscreen, the first set of selectable indicia being indicative of respective brands, and displaying, on the touchscreen, a second set of indicia being indicative of respective flavors for the selected brands. Information associated with the consumable ingredients may be stored, where the information may include the brand names and available flavors for each of the respective brands in a database. The stored information of the consumable ingredients for use in predicting the combinations of consumable ingredients most likely to have been intended to be selected by the user in receiving the swype gesture may be accessed. A first set of indicia displayed on a touchscreen may include displaying a first set of selectable indicia on a touchscreen positioned on the dispenser. The user may be enabled, via the touchscreen, to selectably cause the selected predicted combination of consumable ingredients to be communicated from the dispenser to an electronic device remotely positioned from the dispenser over a communications network to enable the user to access the selected predicted combination of consumable ingredients at a later time.

The prediction of the combination of consumable ingredients most likely to have been intended to be selected by the user may include predicting a combination of consumable ingredients most likely to have been selected by the user based on the path of the swype gesture of the user and historical swype gestures by other users having a similar path of swype gesture as performed by the user. The prediction of the combination of consumable ingredients most likely to have been intended to be selected by the user includes predicting a plurality of combinations of consumable ingredients most likely to have been intended to be selected by the user. The predicted combinations of consumable ingredients may be displayed for selection of one of the predicted combinations of consumable ingredients.

Figure 25:
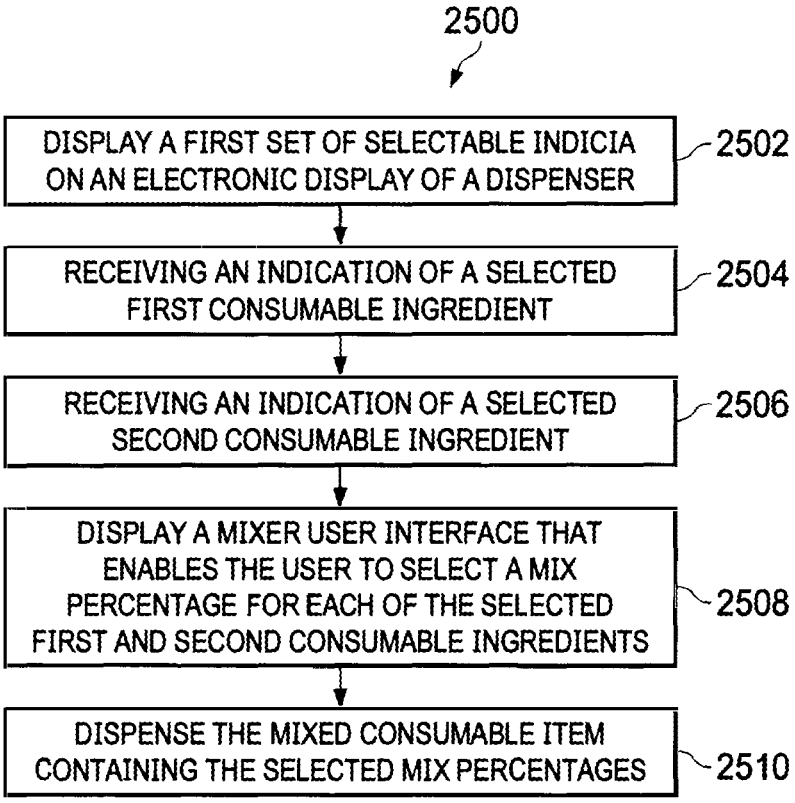
FIG. 25 is a flow diagram of an illustrative process for creating a mixed consumable item may include displaying a first set of selectable indicia on an electronic display of a dispenser configured to dispense consumable items.

With regard to FIG. 25, a flow diagram of an illustrative process 2500 for creating a mixed consumable item may include displaying a first set of selectable indicia on an electronic display of a dispenser configured to dispense consumable items at step 2502. The first set of selectable indicia may be indicative of respective consumable ingredients. At step 2504, an indication of a selected first consumable ingredient may be received in response to a user selecting a first indicia. At step 2506, an indication of a selected second consumable ingredient may be received in response to a user selecting a second indicia. A mixer user interface that enables the user to select a mix percentage for each of the selected first and second consumable ingredients may be displayed on the electronic display at step 2508. At step 2510, the mixed consumable item containing the selected mix percentages of the selected first and second selected consumable ingredients may be dispensed by the dispenser.

The process 2500 may further include enabling, via the electronic display, the user to repeatedly adjust the selected mix percentages of the selected first and second selected consumable ingredients. At the dispenser, the user may be enabled (i) to enter at least one network address to share information that describes the mixed consumable item that enables the user or another user to reproduce the mixed consumable item by another dispenser, (ii) to generate, by a processing unit of the dispenser, a mix code representative of the selected first and second consumable ingredients and mix percentages of each of the selected first and second consumable ingredients, and (iii) to cause, by the processing unit and a communications device of the dispenser, a communication of the mix code to the network address(es).

Moreover, on a mobile electronic device of a user, an indicia associated with the dispenser may be enabled to be scanned to cause the mobile electronic device to communicate with a server located on a communications network, which, in turn, causes the server to (i) communicate with the dispenser so as to enable the dispenser to upload a mix code that describes the mixed consumable item to the server, and (ii) communicate the uploaded mix code to the mobile electronic device of the user for storage thereat. The dispenser may receive a mix code from an electronic device of the user to cause the dispenser to be configured to dispense the mixed consumable item defined by the mix code. A swype gesture produced by the user along the electronic display configured as a touchscreen may be read, and responsive to reading the swype gesture, multiple combinations of consumable ingredients most likely to have been intended to have been selected by the user may be predicted. A selectable set of the predicted combinations of consumable ingredients may be displayed, and in response to receiving a selected predicted combination of consumable ingredients from amongst the displayed predicted combinations of consumable ingredients by the user, the dispenser may be enabled to dispense the selected combination of consumable ingredients.

A wireless communications link between the dispenser and a mobile electronic device of the user may be established, and a mix code representative of the selected combination of consumable ingredients may be caused to be communicated via the wireless communications link from the dispenser to the mobile electronic device for storage thereat. Any of multiple dispensers may (i) receive a mix code representative of the selected first and second consumable ingredients and mix percentages of each of the selected first and second consumable ingredients, and, (ii) responsive to a dispenser receiving the mix code, the dispenser may be caused to be configured to produce the mixed consumable item by mixing the selected first and second consumable ingredients along with the mix percentages of the selected first and second consumable ingredients.

Displaying the first set of selectable indicia may include (i) displaying a set of selectable brand indicia, and (ii) displaying a set of selectable indicia inclusive of flavors of a selected brand in response to receiving a selected brand indicia. Displaying the first set of selectable indicia may include (i) first displaying multiple selectable brand indicia, and, (ii) responsive to receiving a selected brand indicia, second displaying at least a portion of the selectable brand indicia other than the selected brand indicia from which the user is to select.

In an embodiment, responsive to receiving a selected combination of consumable ingredients, the user may be enabled to cause the mixed consumable items to be dispensed via the dispenser of consumable items. A user interface may be displayed on the touchscreen with adjustable display elements to enable the user to set percentages of the selected consumable ingredients to be mixed. An electronic device on which the touchscreen is operating may communicate a mix code that describes the selected predicted combination of consumable ingredients to the dispenser, where the mix code may cause the dispenser to display the selected predicted consumable ingredients and percentages thereof set by the user.

The user may be enabled to select a dispenser to communicate the selected predicted combination of consumable ingredients for mixing thereby. The selected predicted combination of consumable ingredients may be stored in a temporary database to enable the user to alter mix percentages of the selected predicted consumable ingredients set by the user for a predetermined period of time. A first set of selectable indicia may be displayed, on the touchscreen, the first set of selectable indicia being indicative of respective brands, and a second set of indicia being indicative of respective flavors for the selected brands may also be displayed on the touchscreen.

In an embodiment, information associated with the consumable ingredients may be displayed, where the information may include the brand names and available flavors for each of the respective brands in a database. The stored information of the consumable ingredients for use in predicting the combinations of consumable ingredients most likely to have been intended to be selected by the user in receiving the swype gesture may be accessed. A first set of selectable indicia may be displayed on a touchscreen positioned on the dispenser. In an aspect, the user may be enabled, via the touchscreen, to selectably cause the selected predicted combination of consumable ingredients to be communicated from the dispenser to an electronic device remotely positioned from the dispenser over a communications network to enable the user to access the selected predicted combination of consumable ingredients at a later time. Predicting the combinations of consumable ingredients most likely to have been intended to be selected by the user may include predicting combinations of consumable ingredients most likely to have been selected by the user based on the path of the swype gesture of the user and historical swype gestures by other users having a similar path of swype gesture as performed by the user.

The foregoing method descriptions and the process flow diagrams are provided merely as illustrative examples and are not intended to require or imply that the steps of the various embodiments must be performed in the order presented. As will be appreciated by one of skill in the art, the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations may be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

The various illustrative logical blocks, modules, circuits, and algorithm steps described in connection with the embodiments disclosed here may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to and/or in communication with another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the invention. Thus, the operation and behavior of the systems and methods were described without reference to the specific software code being understood that software and control hardware can be designed to implement the systems and methods based on the description here.

When implemented in software, the functions may be stored as one or more instructions or code on a non-transitory computer-readable or processor-readable storage medium. The steps of a method or algorithm disclosed here may be embodied in a processor-executable software module which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used here, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

The previous description is of a preferred embodiment for implementing the invention, and the scope of the invention should not necessarily be limited by this description. The scope of the present invention is instead defined by the following claims.

The invention claimed is:

1. A method for creating a mixed consumable item, said method comprising:

displaying a first set of selectable indicia on a touchscreen, the indicia being (i) indicative of respective consumable ingredients and (ii) distinctly positioned relative to one another;

receiving swype path data generated by the touchscreen in response to a swype gesture made by a user via the touchscreen, the swype path data representing a path of the swype gesture extending between a first position and a second position that touches or passes close to at least two of the selectable indicia;

predicting, by the swype interpretation processor, from the first set of consumable ingredients, a combination of consumable ingredients most likely to have been intended to be selected by the user based on the swype path data of the swype gesture generated by the touchscreen;

displaying, on the touchscreen, the predicted combination of consumable ingredients; and receiving, by a processing unit, a selected predicted combination of consumable ingredients from the user for mixing by a dispenser of consumable items.

2. The method according to claim 1, further comprising responsive to receiving the selected predicted combination of consumable ingredients, enabling the user to cause the mixed consumable items to be dispensed via the dispenser of consumable items.

3. The method according to claim 1, further comprising displaying a user interface on the touchscreen with adjustable display elements to enable the user to set relative amounts of the selected consumable ingredients to be mixed.

4. The method according to claim 3, further comprising communicating, by an electronic device on which the touchscreen is operating, a mix code that describes the selected predicted combination of consumable ingredients to the dispenser, the mix code causing the dispenser to display the selected predicted consumable ingredients and relative amounts thereof set by the user.

5. The method according to claim 1, wherein displaying a first set of indicia on a touchscreen includes displaying a first set of selectable indicia on a touchscreen positioned on the dispenser, and further comprising enabling, via the touchscreen, the user to selectably cause the selected predicted combination of consumable ingredients to be communicated from the dispenser to an electronic device remotely positioned from the dispenser over a communications network to enable the user to access the selected predicted combination of consumable ingredients at a later time.

6. The method according to claim 1, wherein the combination is predicted based on the path of the swype gesture and historical swype gestures by other users.

7. The method according to claim 1, wherein the combination is predicted based on the path of the swype gesture and historical swype gestures by the user.

8. The method according to claim 1, wherein the combination is predicted based on the path of the swype gesture and a filter applied to a set of predicted swype paths.

9. The method according to claim 8, wherein the filter based on historical knowledge indicating a percentage of a sample size population that combines consumable ingredients in the set of predicted swype paths.

10. A system for creating a consumable item mix, said system comprising:

a non-transitory memory device configured to store information;

a touchscreen configured to display information; and a processing unit in communication with said non-transitory memory and touchscreen, and configured to:

display a first set of selectable indicia on a touchscreen, the indicia being (i) indicative of respective consumable ingredients and (ii) distinctly positioned relative to one another;

receive, from the touchscreen, swype path data generated by the touchscreen in response to a swype gesture made by a user on the touchscreen, the swype path data representing a path of the swype gesture extending between a first position and a second position that touches or passes close to at least two of the selectable indicia;

predict, from the first set of consumable ingredients, a combination of consumable ingredients most likely to have been intended to be selected by the user based on the swype path data of the swype gesture generated by the touchscreen; and display, on the touchscreen, the predicted combination of consumable ingredients; and receive a selected combination of consumable ingredients from the user for mixing by a dispenser of consumable items.

11. The system according to claim 10, wherein said processing unit, in response to receiving the selected predicted combination of consumable ingredients, is further configured to enable the user to cause the mixed consumable items to be dispensed via the dispenser of consumable items.

12. The system according to claim 10, wherein said processing unit is further configured to display a user interface on the touchscreen with adjustable display elements to enable the user to set relative amounts of the selected consumable ingredients to be mixed.

13. The system according to claim 12, further comprising an input/output (I/O) unit, and wherein said processing unit is further configured to communicate via said I/O unit a mix code that describes the selected predicted combination of consumable ingredients to the dispenser, the mix code causing the dispenser to display the selected predicted consumable ingredients and relative amounts thereof set by the user.

14. The system according to claim 10, wherein said processing unit displaying a first set of indicia on said touchscreen is configured to display a first set of selectable indicia on a touchscreen positioned on the dispenser, and wherein said processing unit is further configured to enable, via the touchscreen, the user to selectably cause the selected predicted combination of consumable ingredients to be communicated from the dispenser to an electronic device remotely positioned from the dispenser over a communications network to enable the user to access the selected predicted combination of consumable ingredients at a later time.

15. The system according to claim 10, wherein the combination is predicted based on the path of the swype gesture and historical swype gestures by other users.

16. The system according to claim 10, wherein the combination is predicted based on the path of the swype gesture and historical swype gestures by the user.

17. The system according to claim 10, wherein the combination is predicted based on the path of the swype gesture and a filter applied to a set of predicted swype paths.

18. The system according to claim 17, wherein the filter based on historical knowledge indicating a percentage of a sample size population that combines consumable ingredients in the set of predicted swype paths.

* * * * *